US012180971B2

(12) United States Patent
Tokuno

(10) Patent No.: US 12,180,971 B2
(45) Date of Patent: Dec. 31, 2024

(54) BLOWER DEVICE

(71) Applicant: Nidec Corporation, Kyoto (JP)

(72) Inventor: Yuta Tokuno, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 124 days.

(21) Appl. No.: 18/077,266

(22) Filed: Dec. 8, 2022

(65) Prior Publication Data

US 2023/0213036 A1 Jul. 6, 2023

(30) Foreign Application Priority Data

Dec. 24, 2021 (JP) ..... 2021-210907
Dec. 24, 2021 (JP) ..... 2021-210911
Dec. 24, 2021 (JP) ..... 2021-210914

(51) Int. Cl.
*F04D 19/00* (2006.01)
*F04D 29/52* (2006.01)
*F04D 29/54* (2006.01)

(52) U.S. Cl.
CPC ..... *F04D 19/002* (2013.01); *F04D 29/522* (2013.01); *F04D 29/541* (2013.01)

(58) Field of Classification Search
CPC ..... F04D 19/002; F04D 29/522; F04D 29/646
See application file for complete search history.

(56) References Cited

U.S. PATENT DOCUMENTS 10,697,466 B2 * 6/2020 Hakozaki ..... F04D 29/164
2020/0378403 A1 * 12/2020 Tokuno ..... F04D 29/522

* cited by examiner

*Primary Examiner* — Sabbir Hasan
(74) *Attorney, Agent, or Firm* — Keating & Bennett, LLP

(57) ABSTRACT

A blower device includes a pair of fans, a housing, and a lid. The pair of fans generates an airflow on one side in the axial direction along the central axis and is coaxially arranged. The housing has a tubular shape extending along the central axis, accommodates the pair of fans, and has two end surfaces opened in the axial direction. The lids cover axial end surfaces of the housing and provide ventilation. The lid includes an annular portion in contact with the inner peripheral surface of the housing and including a through hole penetrating in the radial direction. The housing includes an engagement protrusion that protrudes radially inward from the inner peripheral surface and engages with the periphery of the through hole.

13 Claims, 8 Drawing Sheets

BLOWER DEVICE

CROSS-REFERENCE TO RELATED APPLICATIONS

The present application claims priority under 35 U.S.C. § 119 to Japanese Patent Applications No. 2021-210907, 2021-210911, and 2021-210914, all filed on Dec. 24, 2021, the entire contents of which are hereby incorporated herein by reference.

1. FIELD OF THE INVENTION

The present disclosure relates to a blower device.

2. BACKGROUND

In the conventional blower device, a housing surrounding a central axis is formed by axially connecting a first divisional housing unit and a second divisional housing unit. The first divisional housing unit accommodates a first motor that rotates a first impeller about the central axis. The second divisional housing unit accommodates a second motor that rotates a second impeller about the central axis. At this time, a first support frame main body half portion for fixing the first motor and a second support frame main body half portion for fixing the second motor are arranged to face the axial center portion in the housing.

However, in the conventional blower device, the connecting structure of the first divisional housing unit and the second divisional housing unit is complicated, and there is a possibility that assembly workability is deteriorated. Further, in the conventional blower device, there is a possibility that the airflow in the housing is disturbed by the first support frame main body half portion and the second support frame main body half portion, and that the blowing efficiency is lowered. Further, in the conventional blower device, there is a possibility that the vibration of the first divisional housing unit and the vibration of the second divisional housing unit resonate with each other to increase the vibration of the entire housing.

SUMMARY

A blower device according to an example embodiment of the present disclosure includes a pair of fans, a housing, and lids. The pair of fans generates an airflow on one side in the axial direction along the central axis and is coaxially arranged with respect to one another. The housing has a tubular shape extending along the central axis, accommodates the pair of fans, and includes two end surfaces opened in the axial direction. The lids cover one axial end surface and another axial end surface of the housing respectively, and ventilate. The lid includes an annular portion. The annular portion is in contact with the inner peripheral surface of the housing, and includes a through hole penetrating in the radial direction. The housing includes an engagement protrusion that protrudes radially inward from the inner peripheral surface and engages with the periphery of the through hole.

A blower device according to an example embodiment of the present disclosure includes a pair of fans, a housing, and lids. The pair of fans generates an airflow on one side in the axial direction along the central axis and is coaxially arranged with respect to one another. The housing has a tubular shape extending along the central axis, accommodates the pair of fans, and includes two end surfaces opened in the axial direction. The lids cover a first axial end surface and a second axial end surface of the housing respectively, and provide ventilation. The pair of fans is fixed to the lids and includes a motor that rotates the impeller. The impeller includes an impeller cylindrical portion, an impeller lid, and blades. The impeller cylindrical portion is located radially outside with respect to the motor, and extends in an axial direction. The impeller lid covers an axial end surface of the impeller cylindrical portion on the side axially opposite to the lid to which the motor is fixed. The blades are located on the radially outer surface of the impeller cylindrical portion in the circumferential direction. In the pair of fans, the respective impeller lids directly oppose each other in the axial direction.

A blower device according to an example embodiment of the present disclosure includes a pair of fans, a housing, and lids. The pair of fans generates an airflow on one side in the axial direction along the central axis and is coaxially arranged with respect to one another. The housing has a tubular shape extending along the central axis, accommodates the pair of fans, and includes two end surfaces opened in the axial direction. The lids cover one axial end surface and the other axial end surface of the housing respectively, and ventilate. The material of the lid is different from the material of the housing.

The above and other elements, features, steps, characteristics and advantages of the present disclosure will become more apparent from the following detailed description of the example embodiments with reference to the attached drawings.

DETAILED DESCRIPTION

Hereinafter, example embodiments of a first disclosure will be described in detail with reference to the accompanying drawings. In the specification, a direction in which a central axis J of a blower device 1 extends is simply referred to as an "axial direction", a direction perpendicular to the central axis J of the blower device 1 as the center is simply referred to as a "radial direction", and a direction extending along a circular arc centered on the central axis J of the blower device 1 is simply referred to as a "circumferential direction". Further, a section parallel to the axial direction is referred to as a "longitudinal section". Further, the term "parallel" does not mean parallel in a strict sense, but includes substantially parallel.

Figure 1:
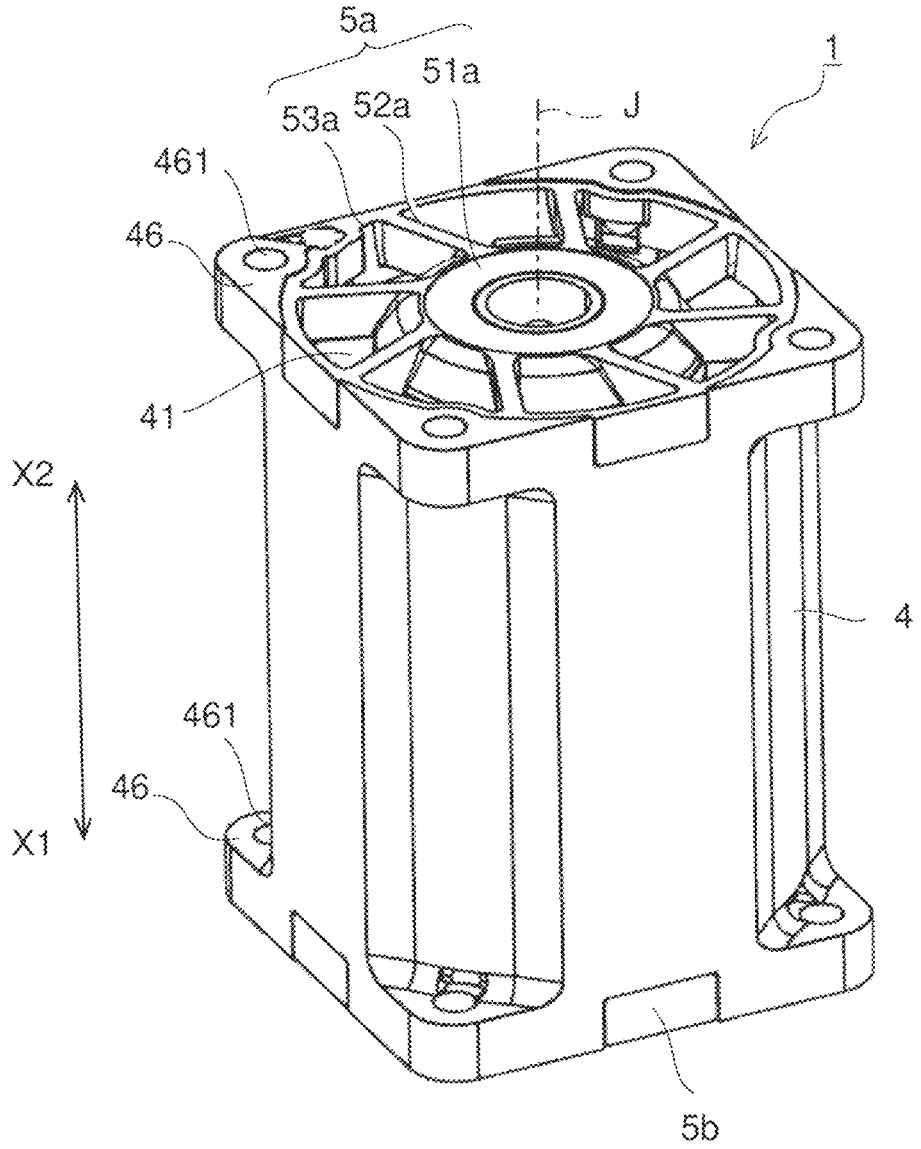
FIG. 1 is an overall perspective view of a blower device according to an example embodiment of the present disclosure.

It is also assumed that an axial direction is a vertical direction for the sake of convenience in description, and the shape and relative positions of members or portions will be described on the assumption that a vertical direction and upper and lower sides in FIG. 1 are a vertical direction and upper and lower sides of the blower device 1. For example, one side in the axial direction is defined as an axially upper side or an upper side. The other side in the axial direction is defined as an axially lower side or a lower side. Further, one axial end is defined as an upper end, and the other axial end is defined as a lower end. Further, one axial end surface is defined as an upper end surface, and the other axial end surface is defined as a lower end surface. The "upper side" of the blower device 1 is an "intake side" and the "lower side" of the blower device 1 is an "exhaust side". It should be noted, however, that the above definition of the vertical direction and the upper and lower sides is not meant to restrict in any way the orientation of, or relative positions of different members or portions of, the blower device 1 when in use.

Figure 2:
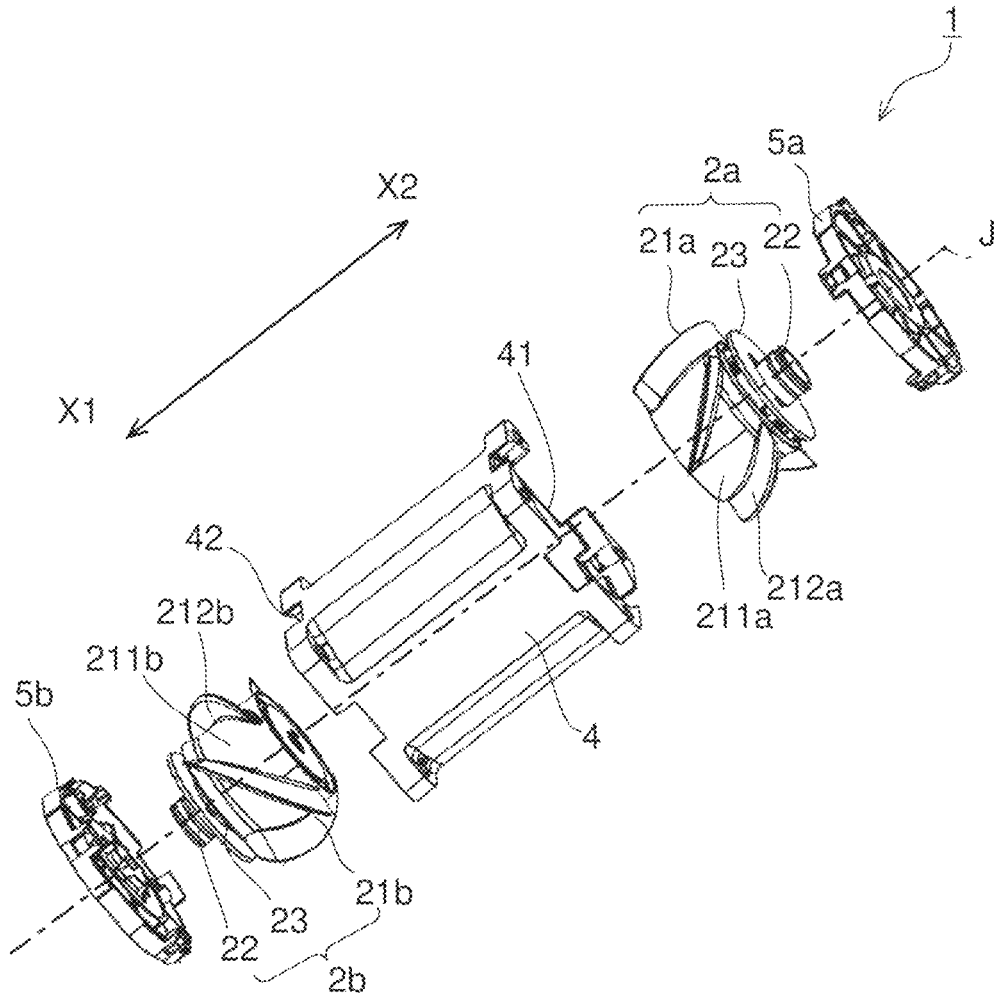
FIG. 2 is an exploded perspective view of a blower device according to an example embodiment of the present disclosure.

FIG. 1 is an overall perspective view of an example of the blower device 1 according to an example embodiment of the present disclosure, and FIG. 2 is an exploded perspective view of the blower device 1. The blower device 1 includes a pair of fans 2*a* and 2*b*, a housing 4, and lids 5*a* and 5*b*.

The fans 2*a* and 2*b* generate an airflow on the axially lower side (one side in the axial direction) X1 along the central axis J, and are coaxially disposed. The fan 2*a* is disposed on the intake side, and includes an impeller 21*a*, a motor 22, and a circuit board 23. The fan 2*b* is disposed on the exhaust side, and includes an impeller 21*b*, a motor 22, and a circuit board 23. In the present example embodiment, the fan 2*a* and the fan 2*b* have the same configurations of the motor 22 and the circuit board 23, and are described with the same reference numerals.

The housing 4 is formed in a tubular shape extending along the central axis J, accommodates the pair of fans 2*a* and 2*b*, and has both end surfaces opened in the axial direction. The housing 4 includes an airflow passage in which the air flows inside. The housing 4 has an exhaust port 42 on the lower end surface (one axial end surface) and an intake port 41 on the upper end side (the other axial end surface).

The lid 5*a* covers the intake port 41 (the other axial end surface) of the housing 4, and ventilates. The lid 5*b* covers the exhaust port 42 (one axial end surface) of the housing 4, and ventilates. The fan 2*a* is fixed to the lid 5*a*, and the fan 2*b* is fixed to the lid 5*b*.

The lids 5*a* and 5*b* and the housing 4 are resin molded members, and the material constituting the lids 5*a* and 5*b* is different from the material constituting the housing 4. Specifically, the Young's modulus of the material constituting the lids 5*a* and 5*b* is higher than the Young's modulus of the material constituting the housing 4. As a result, it is possible to make the vibration frequency of the lids 5*a* and 5*b* and the vibration frequency of the housing 4 different. Therefore, resonance of the lids 5*a* and 5*b* and the housing 4 can be reduced. Thus, vibration of the blower device 1 can be reduced.

Specifically, when polyphenylene sulfide or polybutylene terephthalate is used as the material constituting the lids 5*a* and 5*b*, polyphenylene ether can be suitably used as the material constituting the housing 4. Meanwhile, when polyphenylene sulfide is used as the material constituting the lids 5*a* and 5*b*, polybutylene terephthalate can be suitably used as the material constituting the housing 4. By using these materials, it is possible to further reduce the vibration of the blower device 1 while maintaining the strength of the lids 5*a* and 5*b* and the housing 4.

Figure 3:
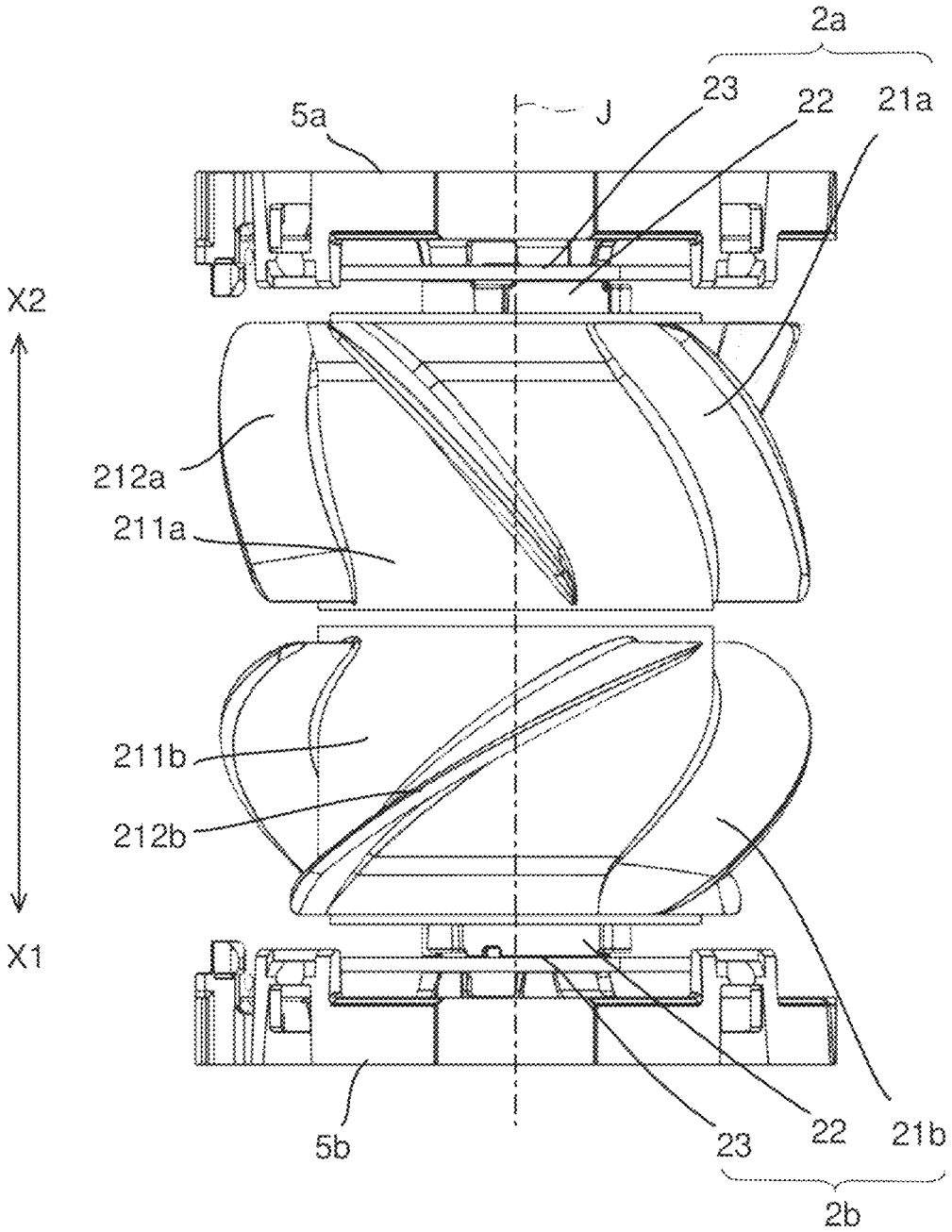
FIG. 3 is a side view of a blower device according to an example embodiment of the present disclosure.

FIG. 3 is a side view of the blower device 1. In FIG. 3, the housing 4 is omitted. The impeller 21*a* is disposed radially outside the motor 22 and is rotated about the central axis J by the motor 22. The impeller 21*b* is disposed radially outside the motor 22 and is rotated about the central axis J by the motor 22. The rotation direction of the impeller 21*a* is opposite to the rotation direction of the impeller 21*b*. Depending on the shapes of the impellers 21*a* and 21*b*, the rotation direction of the impeller 21*a* and the rotation direction of the impeller 21*b* may be the same.

The impeller 21*a* includes an impeller cup 211*a* and a plurality of blades 212*a*. The impeller cup 211*a* is fixed to the motor 22. The impeller cup 211*a* includes an impeller tubular portion 2112*a* and an impeller lid 2111*a*. The impeller tubular portion 2112*a* is disposed radially outside the motor 22 of the fan 2*a*, and extends in the axial direction. The impeller lid 2111*a* covers the lower end surface (one axial end surface) of the impeller tubular portion 2112*a*. The plurality of blades 212*a* are disposed on the outer surface of the impeller tubular portion 2112*a* in the circumferential direction.

The impeller 21*b* includes an impeller cup 211*b* and a plurality of blades 212*b*. The impeller cup 211*b* is fixed to the motor 22. The impeller cup 211*b* includes an impeller tubular portion 2112*b* and an impeller lid 2111*b*. The impeller tubular portion 2112*b* is disposed radially outside the motor 22 of the fan 2*b*, and extends in the axial direction. The impeller lid 2111*b* covers the upper end surface (the other axial end surface) of the impeller tubular portion 2112*b*. The plurality of blades 212*b* are disposed on the outer surface of the impeller tubular portion 2112*b* in the circumferential direction.

An inclination angle of the blade 212*a* with respect to the central axis J when the impeller 21*a* disposed on the intake side is developed in the circumferential direction is smaller than an inclination angle of the blade 212*b* with respect to central axis J when the impeller 21*b* disposed on the exhaust side is developed in the circumferential direction. As a result, the air volume of the impeller 21*a* can be made larger than the air volume of the impeller 21*b* to efficiently suck air, and the blowing efficiency of the blower device 1 can be further improved. Note that the inclination angle is an attachment angle of the blade 212*a* and the blade 212*b*.

The impeller lid 2111*a* and the impeller lid 2111*b* directly face each other in the axial direction with no other member disposed therebetween. As a result, the impeller 21*a* and the impeller 21*b* are arranged close to each other in the axial direction, and it is possible to reduce the airflow from flowing into the gap between the impeller lid 2111*a* and the impeller lid 2111*b*. Accordingly, the airflow inside the housing 4 can be smoothly circulated. Therefore, the air blowing efficiency in the housing 4 can be improved.

The impeller lid 2111*a* and the impeller lid 2111*b* are disposed parallel to a plane orthogonal to the central axis J. Thus, the impeller lid 2111*a* and the impeller lid 2111*b* can be disposed closer to each other. Therefore, it is possible to further reduce the airflow from flowing into the gap between the impeller lid 2111*a* and the impeller lid 2111*b*.

Figure 4:
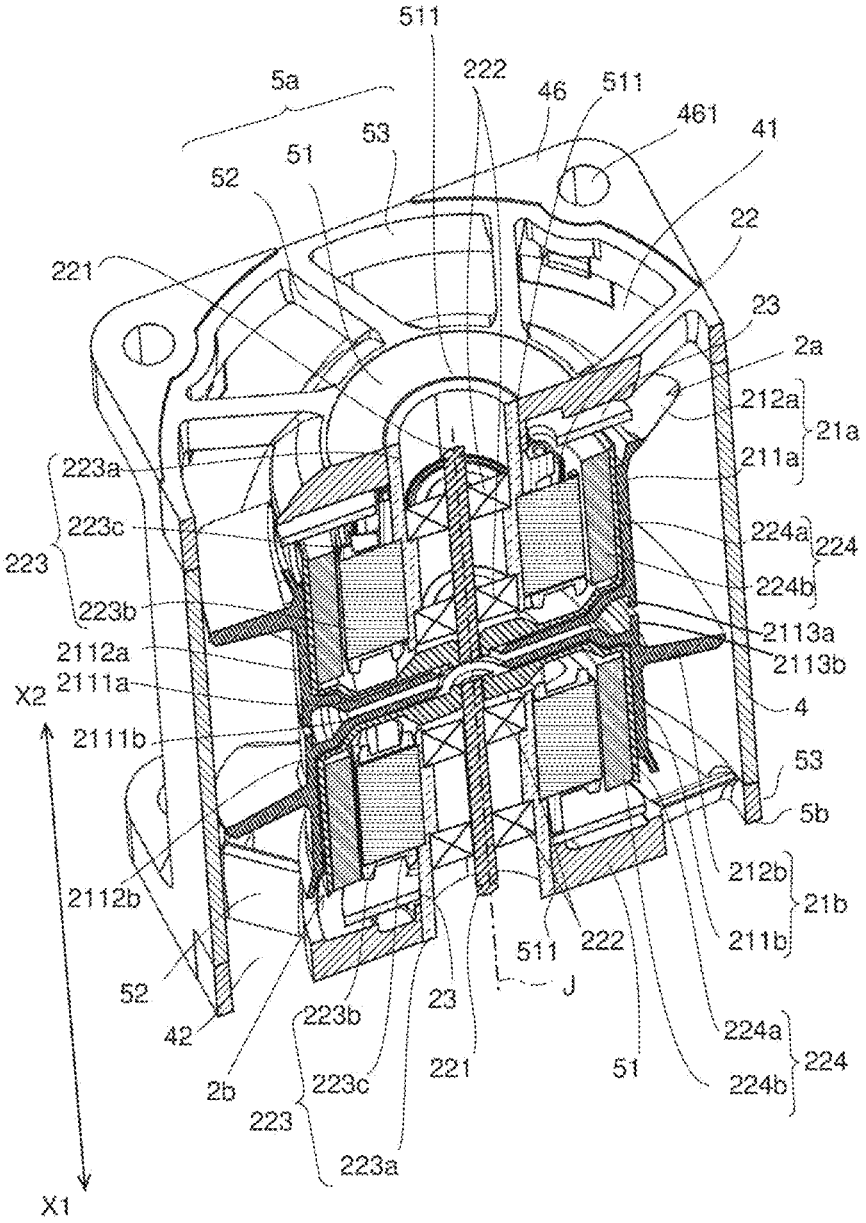
FIG. 4 is a vertical sectional perspective view of a blower device according to an example embodiment of the present disclosure.

The impeller lid 2111*a* has an annular impeller protrusion 2113*a* that is provided at the radially outer end portion and protrudes axially downward (one side in the axial direction) X1 (see FIG. 4). The impeller lid 2111*b* has an annular impeller protrusion 2113*b* that is provided at the radially outer end portion and protrudes axially upward (the other side in the axial direction) X2 (see FIG. 4). As a result, it is possible to further reduce the airflow from flowing into the gap between the impeller lid 2111*a* and the impeller lid 2111*b*. At least one of the impeller protrusion 2113*a* and the impeller protrusion 2113*b* may be provided in a plural number in the radial direction. As a result, it is possible to further reduce the airflow from flowing into the gap between the impeller lid 2111*a* and the impeller lid 2111*b*. The impeller protrusions 2113*a* and the impeller protrusions 2113*b* may be divided into a plurality of parts in the circumferential direction.

The impeller protrusion 2113*a* and the impeller protrusion 2113*b* face each other in the axial direction and extend in parallel with the axial direction. As a result, it is possible to suppress the turbulence of the airflow flowing along the impeller protrusion 2113*a* and the impeller protrusion 2113*b*. The impeller protrusion 2113*a* and the impeller protrusion 2113*b* may be provided in a displaced manner in the radial direction. In that case, it is preferable that the tip of one of the impeller protrusion 2113*a* and the impeller protrusion 2113*b* extends to the root side from the tip of the other one. As a result, it is possible to further reduce the airflow from flowing into the gap between the impeller lid 2111*a* and the impeller lid 2111*b*.

The outer peripheral surfaces of the impeller tubular portions 2112*a* and 2112*b* are parallel to the axial direction, and the outer diameter of the impeller tubular portion 2112*a* and the outer diameter of the impeller tubular portion 2112*b* are the same. This allows the airflow to smoothly flow from the outer peripheral surface of the impeller tubular portion 2112*a* to the outer peripheral surface of the impeller tubular portion 2112*b*. The outer peripheral surfaces of the impeller tubular portions 2112*a* and 2112*b* may be parallel to the axial direction and the outer diameter of the impeller tubular portion 2112*a* and the outer diameter of the impeller tubular portion 2112*b* may have different sizes. In addition, the outer peripheral surface of the impeller tubular portion 2112*a* and the outer peripheral surface of the impeller tubular portion 2112*b* may be formed in a truncated cone shape inclined radially outward as approaching each other in the axial direction.

FIG. 4 is a longitudinal sectional perspective view of the blower device 1. The pair of motors 22 is fixed to the lids 5*a* and 5*b*, respectively. The motor 22 on the intake side (the other side in the axial direction) X2 rotates the impeller 21*a* about the central axis J. The motor 22 on the exhaust side (one side in the axial direction) X1 rotates the impeller 21*b* about the central axis J. The motor 22 includes a shaft 221, a bearing 222, a stator 223, and a rotor 224.

The shaft 221 extends along the central axis J. The shaft 221 is, for example, a columnar member that is made of metal such as stainless steel, and extends in the axial direction.

A pair of bearings 222 is disposed to face each other at least in the axial direction. The bearing 222 is configured of a ball bearing for example, or may be configured of a sleeve bearing. The pair of bearings 222 supports the shaft 221 so as to be rotatable about the central axis J relative to the housing 4.

The stator 223 includes a bearing holder 223*a*, a stator core 223*b*, an insulator 223*c*, and a coil (not illustrated). The bearing holder 223*a* is formed in a cylindrical shape, and holds the bearing 222 inside.

An upper end portion (outer end portion in the axial direction) of the bearing holder 223*a* of the fan 2*a* is fitted in the fitting hole 511 of the lid 5*a*. As a result, the bearing holder 223*a* is fixed to the lid 5*a*, and the fan 2*a* and the lid 5*a* are fixed to each other. The bearing holder 223*a* and the lid 5*a* may be integrally formed of metal.

A lower end portion (outer end portion in the axial direction) of the bearing holder 223*a* of the fan 2*b* is fitted in the fitting hole 511 of the lid 5*b*. As a result, the bearing holder 223*a* is fixed to the lid 5*b*, and the fan 2*b* and the lid 5*b* are fixed to each other. The bearing holder 223*b* and the lid 5*b* may be integrally formed of metal.

The stator core 223*b* is formed by vertically stacking electromagnetic steel plates such as silicon steel plates. The insulator 223*c* is formed of resin having insulating properties. The insulator 223*c* is provided surrounding an outer surface of the stator core 223*b*. The coil (not illustrated) is formed of a conductive wire wound around the stator core 223*b* with the insulator 223*c* interposed between them.

The rotor 224 rotates about the central axis J with respect to the stator 223. The rotor 224 has a rotor yoke 224*a* and a magnet 224*b*.

The rotor yoke 224*a* is a substantially cylindrical member that is made of a magnetic material and has a lid on the inner side in the axial direction. The rotor yoke 224*a* of the fan 2*a* is fixed to the lower end (inner end in the axial direction) of the shaft 221. The rotor yoke 224*a* of the fan 2*b* is fixed to the upper end (inner end in the axial direction) of the shaft 221. The magnet 224*b* has a cylindrical shape and is fixed to an inner peripheral surface of the rotor yoke 224*a*. The magnet 224*b* is disposed radially outside the stator 223.

The circuit board 23 of the fan 2*a* is disposed between the stator core 223*b* and the lid 5*a*, and the circuit board 23 of the fan 2*b* is disposed between the stator core 223*b* and the lid 5*b*. The circuit board 23 has, for example, a disk shape that extends in the radial direction with the central axis J as the center. The circuit board 23 is electrically connected to a lead wire of the coil (not illustrated). An electric circuit for supplying a drive current to the coil (not illustrated) is mounted on the circuit board 23.

The circuit board 23 has an outer diameter equal to or smaller than the outer diameters of the impeller tubular portions 2112*a* and 2112*b*. As a result, the airflow inside the housing 4 can be more smoothly circulated.

When the drive current is supplied to the coil (not illustrated) of the motor 22 via the circuit board 23 in the fans 2*a* and 2*b* configured as described above, a magnetic flux in the radial direction is generated in the stator core 223*b*. A magnetic field generated by the magnetic flux of the stator core 223*b* and a magnetic field generated by the magnet 224*b* act to generate torque in the circumferential direction of the rotor 224. Due to this torque, the rotor 224 and the impellers 21*a* and 21*b* rotate about the central axis J. When the impellers 21*a* and 21*b* rotate, the plurality of blades 212*a* and 212*b* generate an airflow. As a result, the fans 2*a* and 2*b* can generate an airflow with the axially upper side (the other side in the axial direction) X1 as the intake side and the axially lower side (one side in the axial direction) X2 as the exhaust side, and blow air.

Figure 5:
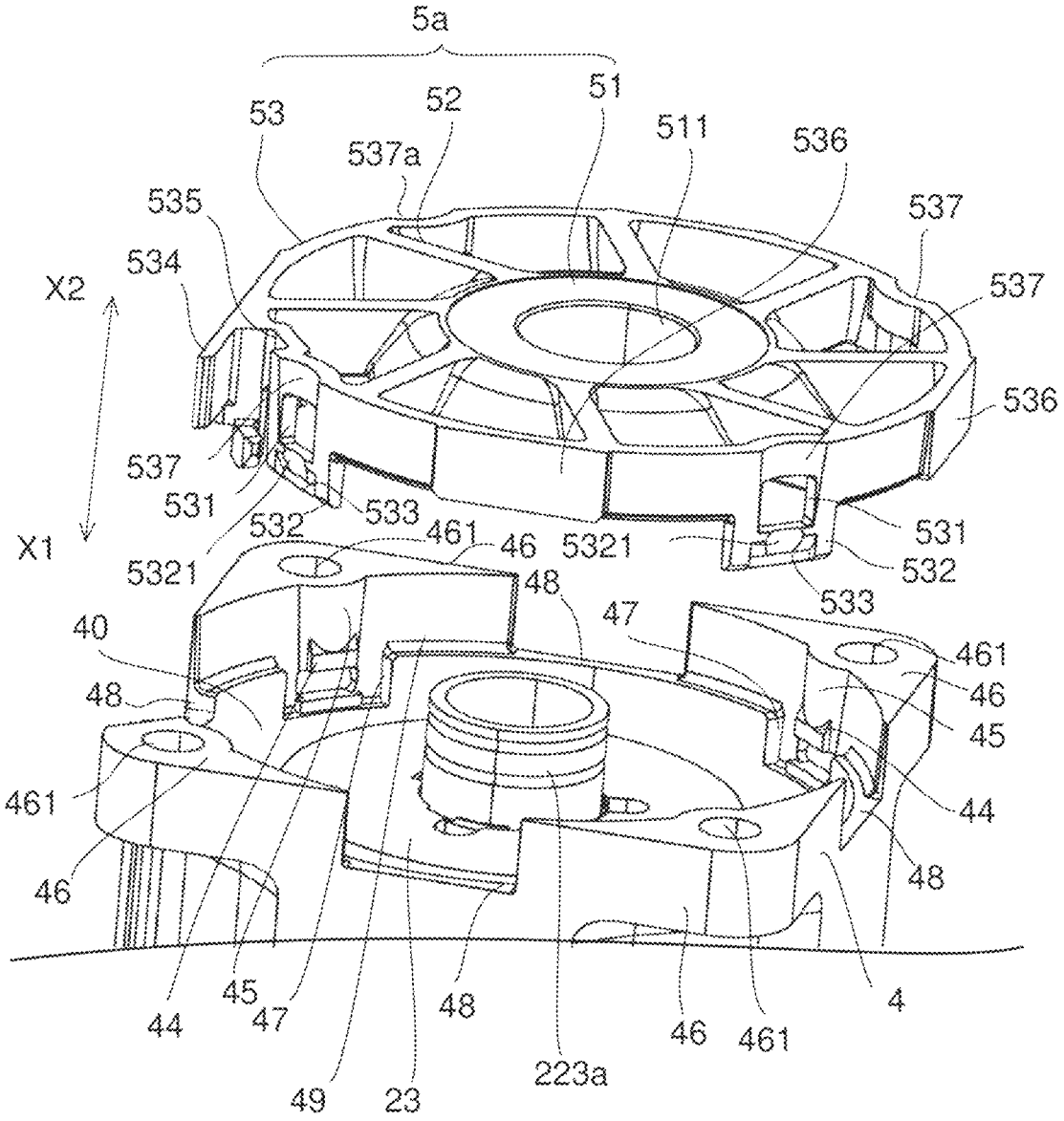
FIG. 5 is an enlarged exploded perspective view illustrating a portion of a blower device according to an example embodiment of the present disclosure.
Figure 6:
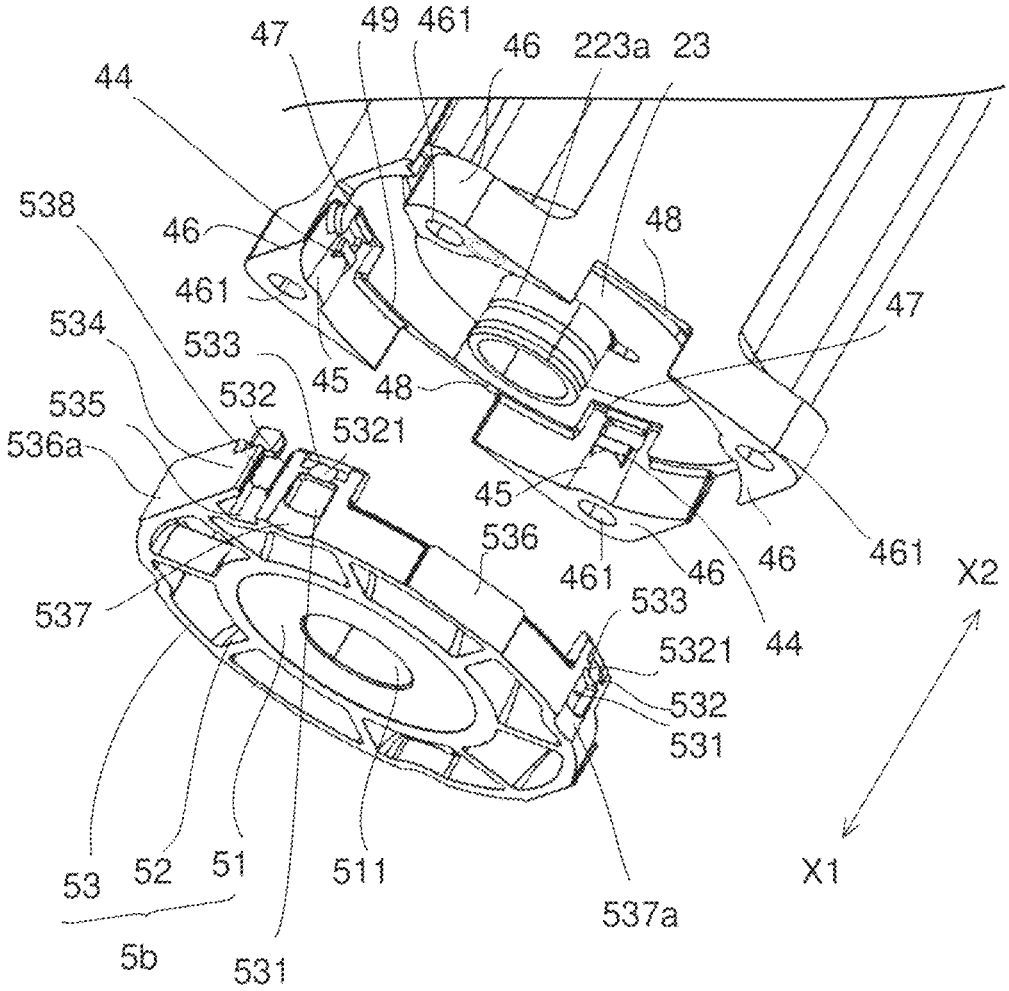
FIG. 6 is an enlarged exploded perspective view illustrating a portion of a blower device according to an example embodiment of the present disclosure.
Figure 7:
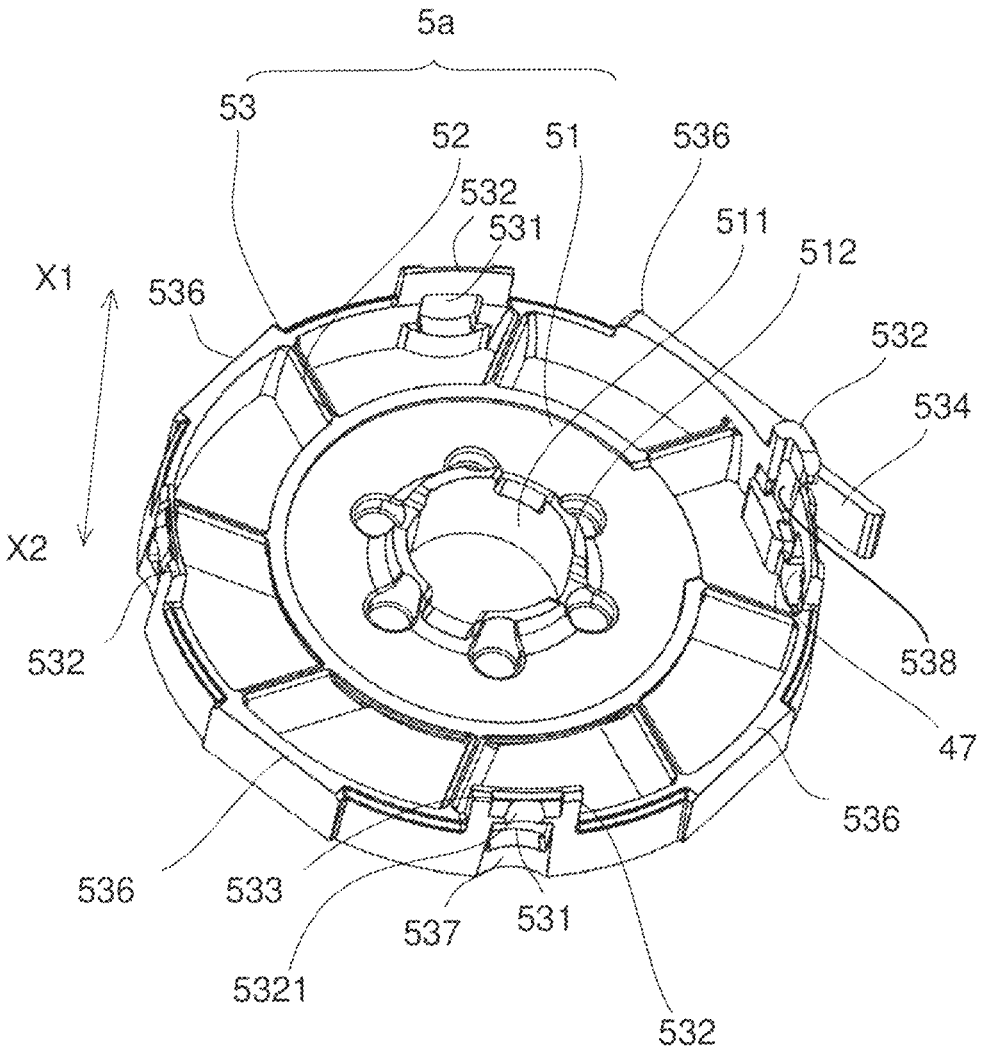
FIG. 7 is a perspective view illustrating a lid of a blower device according to an example embodiment of the present disclosure.

FIGS. 5 and 6 are exploded perspective views of the housing 4 and the lid 5*a*. FIG. 5 illustrates a state in which the housing 4 and the lid 5*a* are viewed from the axially upper side (the other side in the axial direction) X2. FIG. 6 illustrates a state in which the housing 4 and the lid 5*a* are viewed from the axially lower side (one side in the axial direction) X1. FIG. 7 is a perspective view of the lid 5*a*, showing a state in which the lid 5*a* is viewed from the axially lower side (one side in the axial direction) X1.

The lid 5*a* and the lid 5*b* have a fixing portion 51, a connecting portion 52, and an annular portion 53. In the present example embodiment, the lid 5*a* and the lid 5*b* have the same configurations of the fixing portion 51, the connecting portion 52, and the annular portion 53, and will be described with the same reference numerals. The fixing portion 51 is disposed radially inside the annular portion 53.

The fixing portion 51 of the lid 5*a* is disposed on the axially upper side (the other side in the axial direction) X2 of the fan 2*a* and has a disk shape expanding in the radial direction around the central axis J. The fixing portion 51 of the lid 5*b* is disposed on the axially lower side (one side in the axial direction) X1 of the fan 2*b* and has a disk shape expanding in the radial direction around the central axis J.

The fixing portion 51 has a fitting hole 511 and an annular rib 512 (see FIG. 7). The fitting hole 511 is disposed on the central axis J and penetrates the fixing portion 51 in the axial direction. The annular rib 512 of the lid 5*a* protrudes in the axial direction from the lower surface (one axial end surface) of the fixing portion 51 and surrounds the fitting hole 511. The annular rib 512 of the lid 5*b* protrudes in the axial direction from the upper surface (the other axial end surface) of the fixing portion 51 and surrounds the fitting hole 511.

By providing the annular rib 512, the inner surface of the annular rib 512 and the bearing holder 223*a* come into contact with each other in a state where the bearing holder 223*a* is fitted into the fitting hole 511. Thus, the bearing holder 223*a* can be stably supported.

The fixing portion 51 of the lid 5*a* is formed such that the cross-sectional area orthogonal to the central axis J increases toward the axially lower side (one side in the axial direction) X1. As a result, the airflow flowing into the housing 4 from the intake port 41 smoothly flows while spreading radially outward along the peripheral surface of the fixing portion 51. This enables the further improvement of the blowing efficiency of the blower device 1.

A plurality of the connecting portions 52 extend radially outward from the fixing portion 51 and are disposed in the circumferential direction, and connect the annular portion 53 and the fixing portion 51. The air flowing inside the housing 4 passes between the adjacent connecting portions 52.

The connecting portion 52 (the connecting portion disposed on the axially lower side (one side in the axial direction) X1) of the lid 5*b* and the connecting portion 52 (the connecting portion disposed on the axially upper side (the other side in the axial direction) X2) of the lid 5*a* have different shapes. As a result, the shape of the connecting portion 52 on the intake side and the shape of the connecting portion 52 on the exhaust side are made different, and the connecting portion 52 functions as a stator vane, whereby the air blowing efficiency in the housing 4 can be improved.

The connecting portion 52 of the lid 5*a* is formed such that the cross-sectional area orthogonal to the central axis J increases toward the axially lower side (one side in the axial direction) X1. As a result, the airflow flowing into the housing 4 from the intake port 41 smoothly flows along the connecting portion 52. This enables the further improvement of the blowing efficiency of the blower device 1.

The connecting portion 52 of the lid 5*b* is inclined to one side in the circumferential direction toward the axially lower side (one side in the axial direction) X1. As a result, the airflow flowing out of the housing 4 from the exhaust port 42 smoothly flows along the connecting portion 52. This enables the further improvement of the blowing efficiency of the blower device 1.

When viewed from the radial direction, the inclination angle of the connecting portion 52 on the axially upper side (the other side in the axial direction) X2 with respect to the central axis J is smaller than the inclination angle of the connecting portion 52 on the axially lower side (one side in the axial direction) X2 with respect to the central axis J. As a result, the airflow flowing into the housing 4 from the intake port 41 can be smoothly circulated along the connecting portion 52. This enables the further improvement of the blowing efficiency of the blower device 1. The circumferential outer surface of the connecting portion 52 of the lid 5*a* may be formed in parallel with the axial direction.

The annular portion 53 is formed in an annular shape, and an outer peripheral surface of the annular portion 53 and an inner peripheral surface of the housing 4 are in contact with each other. The annular portion 53 is formed with a through hole 531 penetrating in the radial direction. The annular portion 53 includes a protruding piece 532, a groove 533, a holding piece 534, a holding recess 535, a protrusion 536, an engagement recess 537, and a cutout hole 538. The through hole 531, the protruding piece 532, the groove 533, and the engagement recess 537 are arranged in line in the axial direction.

A set of the through hole 531, the protruding piece 532, the groove 533, and the engagement recess 537 is provided at four locations at equal intervals in the circumferential direction. The protrusion 536 is disposed between the through holes 531 adjacent to each other in the circumferential direction, and is provided at four locations at equal intervals in the circumferential direction. The holding piece 534 and the holding recess 535 are provided at one location.

The protruding piece 532 of the lid 5*a* protrudes axially downward X1 from the lower surface of the annular portion 53. The through hole 531 is disposed adjacent to the protruding piece 532 in the axial direction.

The protruding piece 532 of the lid 5*b* protrudes axially upward X2 from the upper surface of the annular portion 53. That is, the protruding pieces 532 of the lids 5*a* and 5*b* protrude in the axial direction from the axial end surface facing the inside of the housing 4.

In the present example embodiment, the through hole 531 is formed across a part of the protruding piece 532. The through hole 531 may be formed only in the annular portion 53 without extending over a part of the protruding piece 532. Instead of the through hole 531, a recess recessed radially inward from the radially outer surface of the annular portion 53 may be formed.

The protruding piece 532 has an inclined portion 5321. The inclined portion 5321 of the lid 5*a* is provided on the axially lower side (side axially closer to fans 2*a*, 2*b*) X1 than the through hole 531 on the outer peripheral surface of the protruding piece 532, and is inclined radially outward toward the axially upper side (axially outer side of the housing 4) X2.

The inclined portion 5321 of the lid 5*b* is arranged on the axially upper side (side axially closer to the fans 2*a*, 2*b*) X2 than the through hole 531 on the outer peripheral surface of the protruding piece 532, and is inclined radially outward toward the axially lower side (axially outer side of the housing 4) X1.

The groove 533 of the lid 5*a* is recessed radially inward from the outer peripheral surface and extends axially at the lower end of the protruding piece 532 (an end in the axial direction facing the inside of the housing 4).

The groove 533 of the lid 5*b* is recessed radially inward from the outer peripheral surface and extends axially at the upper end of the protruding piece 532 (an end in the axial direction facing the inside of the housing 4).

The engagement recess 537 of the lid 5*a* is provided on the axially upper side of the through hole 531 (side axially farther from the fans 2*a*, 2*b* than the through hole 531) X2 and is recessed radially inward from the outer peripheral surface of the annular portion 53.

The engagement recess 537 of the lid 5*b* is provided on the axially lower side of the through hole 531 (side axially farther from the fans 2*a*, 2*b* than the through hole 531) X1 and is recessed radially inward from the outer peripheral surface of the annular portion 53.

The holding piece 534 protrudes radially outward from the outer peripheral surface of the annular portion 53 and extends in the circumferential direction. The holding recess 535 radially faces the holding piece 534 and is recessed radially inward from the outer peripheral surface of the annular portion 53.

The cutout hole 538 is provided radially opposite to a cutout recess 48 and a holding piece 534 of the housing 4 described later. The cutout hole 538 of the lid 5*a* is formed by being cut out axially upward (axial direction) X2 from an end surface of the annular portion 53 facing the inside of the housing 4. The cutout hole 538 of the lid 5*b* is formed by being cut out axially downward (axial direction) X1 from an end surface of the annular portion 53 facing the inside of the housing 4.

A conductive wire (not illustrated) connected to the circuit board 23 of the fan 2*a* and a conductive wire (not illustrated) connected to the circuit board 23 of the fan 2*b* are drawn out to the outside of the housing 4 through the cutout holes 538, respectively. Accordingly, the conductive wire can be prevented from coming into contact with the impeller 21*a* or the impeller 21*b*. Further, by reducing the number of conductive wires passing through the inside of the housing 4, the airflow inside the housing 4 can be more smoothly circulated.

In addition, the drawn conductive wire is held between the holding piece 534 and the holding recess 535. As a result, the conductive wire drawn out to the outside of the housing 4 can be held along the outer peripheral surface of the housing 4. Therefore, the conductive wire is easily routed, and the assembling workability of the blower device 1 is further improved.

The housing 4 has an engagement protrusion 44, a guide portion 45, a flange portion 46, a cutout portion 47, a cutout recess 48, and a stepped portion 49 at each of the lower end (one axial end) and the upper end (the other axial end). The engagement protrusion 44, the guide portion 45, and the cutout portion 47 are arranged in a line in the axial direction. A set of the engagement protrusion 44, the guide portion 45, and the cutout portion 47 is provided at four locations at equal intervals in the circumferential direction at the upper end and the lower end of the housing 4, respectively. The cutout recess 48 is provided in the middle of the engagement protrusions 44 adjacent to each other in the circumferential direction, and is provided at four locations at equal intervals in the circumferential direction at the upper end and the lower end of the housing 4, respectively.

The stepped portion 49 is formed such that the inner peripheral surface is recessed radially outward at both axial ends of the housing 4. The stepped portion 49 contacts the annular portion 53 in the axial direction. By providing the stepped portion 49, the inner peripheral surface of the annular portion 53 and the inner peripheral surface of the housing 4 are formed to be flush with each other. As a result, the airflow inside the housing 4 can be more smoothly circulated.

The engagement protrusions 44 protrude radially inward from inner peripheral surfaces of both axial end portions of the housing 4, respectively. The engagement protrusion 44 is engaged with the periphery of the through hole 531 of the lid 5*a* at the upper end portion of the housing 4. The engagement protrusion 44 is engaged with the periphery of the through hole 531 of the lid 5*b* at the lower end portion of the housing 4.

The guide portion 45 is provided at the axially outer end portion. The guide portion 45 is provided on the axially upper side (outer side in the axial direction) X2 than the engagement protrusion 44 at the upper end portion (the other end in the axial direction) of the housing 4. The guide portion 45 is provided on the axially lower side (outer side in the axial direction) X1 than the engagement protrusion 44 at the lower end portion (one end in the axial direction) of the housing 4. The guide portion 45 protrudes radially inward from the inner peripheral surface of the housing 4 and extends in the axial direction.

The cutout portion 47 is provided on the axially lower side (inner side in the axial direction) X1 than the engagement protrusion 44 at the upper end portion (the other end in the axial direction) of the housing 4, and the stepped portion 49 is formed to be recessed axially downward (inward in the axial direction) X1. The cutout portion 47 is provided on the axially upper side (inner side in the axial direction) X2 than the engagement protrusion 44 at the lower end portion (the other end in the axial direction) of the housing 4, and the stepped portion 49 is formed to be recessed axially upward (inward in the axial direction) X2.

The flange portion 46 protrudes radially outward from the axially outer end portion of the housing 4, and is formed with an attachment hole 461 extending in the axial direction. The blower device 1 is screwed to another device via the attachment hole 461. The flange portion 46 faces the engagement protrusion 44 in the radial direction, and is provided at four locations in each of the upper end portion and the lower end portion of the housing 4. The engagement protrusion 44 and the guide portion 45 are adjacent to the attachment hole 461 in the radial direction. Thus, the periphery of the attachment hole 461 can be formed thick.

The cutout recesses 48 is provided at four locations in each of the upper end portion and the lower end portion of the housing 4. The cutout recess 48 is formed by being cut out axially downward (one side in the axial direction) X1 from the axially upper end surface (the other axial end surface) at the upper end portion of the housing 4. The cutout recess 48 is formed by being cut out axially upward (the other side in the axial direction) X2 from the axially lower end surface (one axial end surface) at the lower end portion of the housing 4.

Figure 8:
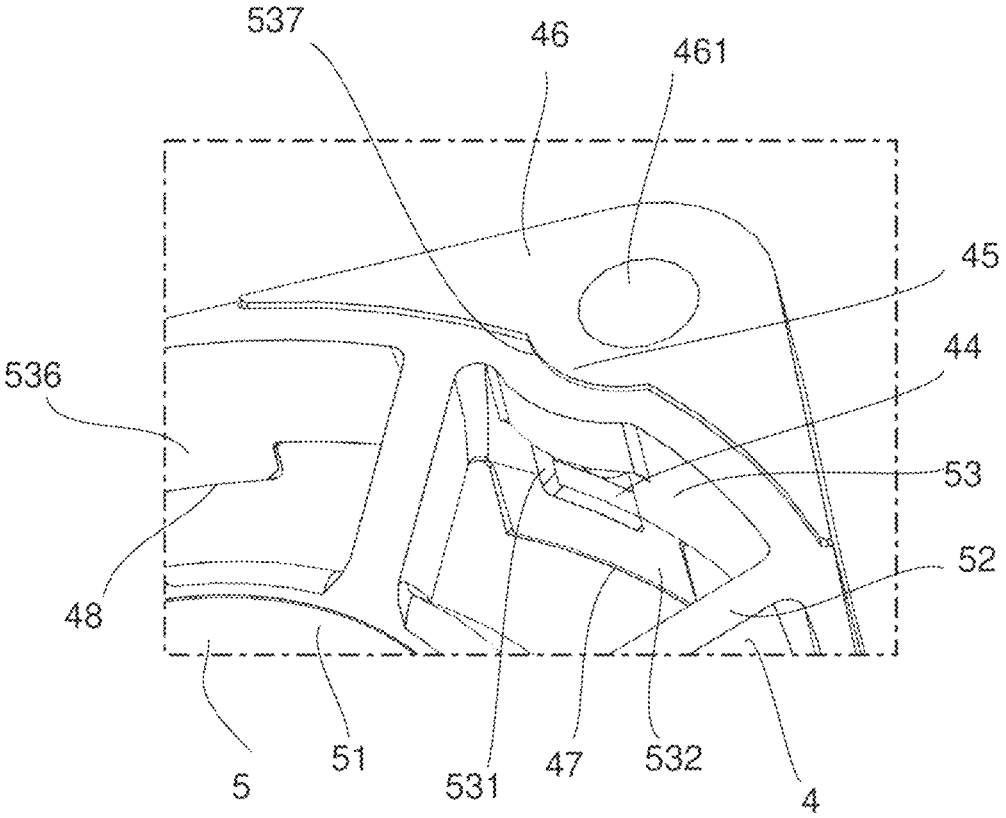
FIG. 8 is an enlarged perspective view illustrating a portion of a blower device according to an example embodiment of the present disclosure.

FIG. 8 is an enlarged perspective view illustrating a part of an upper end portion of the blower device 1. The lid 5*a* is attached to the housing 4 in a state where the fan 2*a* is fixed. At this time, the groove 533 of the protruding piece 532 is brought into contact with the guide portion 45, and the lid 5*a* is inserted into the axially lower side (one side in the axial direction) X1.

The lid 5*b* is attached to the housing 4 in a state where the fan 2*b* is fixed. At this time, the groove 533 of the protruding piece 532 is brought into contact with the guide portion 45, and the lid 5*a* is inserted into the axially upper side (the other side in the axial direction) X2.

At this time, the guide portion 45 slides along the groove 533. This facilitates circumferential positioning of the lids 5*a* and 5*b*, and allows the lids 5*a* and 5*b* to be smoothly inserted inward in the axial direction.

When the engagement protrusion 44 comes into contact with the inclined portion 5321, the protruding piece 532 bends radially inward, and the lids 5*a* and 5*b* are inserted axially inward, whereby the engagement protrusion 44 is inserted into the through hole 531. As a result, the engagement protrusion 44 is engaged with the periphery of the through hole 531, and the protruding piece 532 presses the inner peripheral surface of the housing 4 radially outward. Accordingly, the lids 5*a* and 5*b* are firmly fixed to the housing 4. Therefore, the workability of assembling the lids 5*a* and 5*b* and the housing 4 can be improved.

At this time, by providing the inclined portion 5321, the protruding piece 532 can be easily moved along the guide portion 45. Therefore, the workability of assembling the lid 5*a* and the housing 4 can be further improved.

In addition, the protruding piece 532 is fitted into the cutout portion 47 in a state where the engagement protrusion 44 is engaged with the periphery of the through hole 531. The protrusion 536 is fitted into the cutout recess 48. Further, the guide portion 45 is fitted into the engagement recess 537. The annular portion 53 is in contact with the stepped portion 49 in the axial direction. In addition, a plurality of sets of the through holes 531 and the engagement protrusions 44 to be engaged are arranged at substantially equal intervals in the circumferential direction. As a result, the housing 4 and the lid 5*a* are more firmly fixed in the axial direction and the circumferential direction.

Note that a gap may be partially formed between the outer peripheral surface of the annular portion 53 and the inner peripheral surface of the housing 4. As a result, vibration transmitted from the lids 5*a* and 5*b* to the housing 4 can be reduced.

While example embodiments of the present disclosure have been described above, it will be understood that the scope of the present disclosure is not limited to the above-described example embodiments, and that various modifications may be made to the above-described example embodiments without departing from the gist of the present disclosure. In addition, features of the above-described example embodiments and the modifications thereof may be combined appropriately as desired.

In the present example embodiment, a set of the through hole 531, the protruding piece 532, the groove 533, and the engagement recess 537, and a set of the engagement protrusion 44, the guide portion 45, and the cutout portion 47 are provided at four locations at equal intervals in the circumferential direction, but may be provided at two locations, three locations, or five or more locations.

Although the engagement protrusion 44 and the guide portion 45 are disposed adjacent to the attachment hole 461 in the radial direction, the engagement protrusion 44 and the guide portion 45 may be disposed at positions different from the attachment hole 461 in the circumferential direction. Further, the engagement protrusion 44 may be disposed at a position different from the guide portion 45 in the circumferential direction.

In addition, the housing 4 may be formed to have a diameter that decreases toward the axially lower side (one side in the axial direction). As a result, the airflow inside the housing 4 can be more smoothly circulated toward the exhaust side.

Hereinafter, example embodiments of a second disclosure will be described in detail with reference to the drawings.

(1)

A blower device includes a pair of fans that generates an airflow on one side in an axial direction along a central axis, the pair of fans being coaxially disposed, a housing formed in a tubular shape and extending along the central axis, the housing accommodating the pair of fans, both axial end surfaces of the housing being opened, and a lid that covers each of one axial end surface and the other axial end surface of the housing, and ventilates.

The pair of fans includes a motor that is fixed to each of the lids and rotates an impeller, the impeller includes an impeller tubular portion disposed on a radially outer side of the motor and extending in the axial direction, an impeller lid that covers an axial end surface of the impeller tubular portion on a side axially opposite to the lid to which the motor is fixed, and a plurality of blades arranged in a circumferential direction on a radially outer surface of the impeller tubular portion.

In the pair of fans, the impeller lids directly face each other in the axial direction.

(2)

The impeller lid is disposed parallel to a plane orthogonal to the central axis.

(3)

At least one of the impeller lids facing each other has an impeller protrusion protruding in the axial direction from the radially outer end portion.

(4)

The impeller protrusion extends in parallel with the axial direction.

(5)

The pair of fans has the impeller tubular portion having the same outer diameter.

(6)

An inclination angle of the blade with respect to the central axis when the impeller disposed on the other side in the axial direction is developed in the circumferential direction is smaller than an inclination angle of the blade with respect to central axis J when the impeller disposed on the one side in the axial direction is developed in the circumferential direction.

(7)

The lid includes:

an annular portion in an annular shape that is in contact with an inner peripheral surface of the housing;

a fixing portion which is disposed on a radially inner side of the annular portion and to which the fan is fixed; and a connecting portion that extends radially outward from the fixing portion, a plurality of the connecting portions being disposed in a circumferential direction and connecting the annular portion and the fixing portion.

The connecting portion disposed on the one side in the axial direction and the connecting portion disposed on the other side in the axial direction have different shapes.

(8)

When viewed from the radial direction, the inclination angle of the connecting portion disposed on the other side in the axial direction with respect to the central axis is smaller than the inclination angle of the connecting portion on the one side in the axial direction with respect to the central axis.

(9)

The connecting portion disposed on the other side in the axial direction is formed such that a cross-sectional area orthogonal to the central axis increases toward the one side in the axial direction.

(10)

A circumferential outer surface of the connecting portion disposed on the other side in the axial direction is formed in parallel with the axial direction.

(11)

The fixing portion of the lid disposed on the other side in the axial direction is formed such that a cross-sectional area orthogonal to the central axis increases toward the one side in the axial direction.

(12)

The fixing portion includes a fitting hole disposed on the central axis and penetrating in the axial direction, and an annular rib surrounding the fitting hole and protruding in the axial direction.

The fan includes a bearing holder in a cylindrical shape that holds a bearing inside, the bearing rotatably supporting a shaft extending along the central axis, and the axially outer end portion of the bearing holder is fitted in the fitting hole.

(13)

The housing is formed to have a diameter that decreases toward the one side in the axial direction.

FIG. 1 is an overall perspective view of an example of the blower device 1 according to an example embodiment of the present disclosure, and FIG. 2 is an exploded perspective view of the blower device 1. The blower device 1 includes a pair of fans 2*a* and 2*b*, a housing 4, and lids 5*a* and 5*b*.

The fans 2*a* and 2*b* generate an airflow on the axially lower side (one side in the axial direction) X1 along the central axis J, and are coaxially disposed. The fan 2*a* is disposed on the intake side, and includes an impeller 21*a*, a motor 22, and a circuit board 23. The fan 2*b* is disposed on the exhaust side, and includes an impeller 21*b*, a motor 22, and a circuit board 23. In the present example embodiment, the fan 2*a* and the fan 2*b* have the same configurations of the motor 22 and the circuit board 23, and are described with the same reference numerals.

The housing 4 is formed in a tubular shape extending along the central axis J, accommodates the pair of fans 2*a* and 2*b*, and has both end surfaces opened in the axial direction. The housing 4 includes an airflow passage in which the air flows inside. The housing 4 has an exhaust port 42 on the lower end surface (one axial end surface) and an intake port 41 on the upper end side (the other axial end surface).

The lid 5*a* covers the intake port 41 (the other axial end surface) of the housing 4, and ventilates. The lid 5*b* covers the exhaust port 42 (one axial end surface) of the housing 4, and ventilates. The fan 2*a* is fixed to the lid 5*a*, and the fan 2*b* is fixed to the lid 5*b*.

The lids 5*a* and 5*b* and the housing 4 are resin molded members, and the material constituting the lids 5*a* and 5*b* is different from the material constituting the housing 4. Specifically, the Young's modulus of the material constituting the lids 5*a* and 5*b* is higher than the Young's modulus of the material constituting the housing 4. As a result, it is possible to make the vibration frequency of the lids 5*a* and 5*b* and the vibration frequency of the housing 4 different. Therefore, resonance of the lids 5*a* and 5*b* and the housing 4 can be reduced. Thus, vibration of the blower device 1 can be reduced.

Specifically, when polyphenylene sulfide or polybutylene terephthalate is used as the material constituting the lids 5*a* and 5*b*, polyphenylene ether can be suitably used as the material constituting the housing 4. Meanwhile, when polyphenylene sulfide is used as the material constituting the lids 5*a* and 5*b*, polybutylene terephthalate can be suitably used as the material constituting the housing 4. By using these materials, it is possible to further reduce the vibration of the blower device 1 while maintaining the strength of the lids 5*a* and 5*b* and the housing 4.

FIG. 3 is a side view of the blower device 1. In FIG. 3, the housing 4 is omitted. The impeller 21*a* is disposed radially outside the motor 22 and is rotated about the central axis J by the motor 22. The impeller 21*b* is disposed radially outside the motor 22 and is rotated about the central axis J by the motor 22. The rotation direction of the impeller 21*a* is opposite to the rotation direction of the impeller 21*b*. Depending on the shapes of the impellers 21*a* and 21*b*, the rotation direction of the impeller 21*a* and the rotation direction of the impeller 21*b* may be the same.

The impeller 21*a* includes an impeller cup 211*a* and a plurality of blades 212*a*. The impeller cup 211*a* is fixed to the motor 22. The impeller cup 211*a* includes an impeller tubular portion 2112*a* and an impeller lid 2111*a*. The impeller tubular portion 2112*a* is disposed radially outside the motor 22 of the fan 2*a*, and extends in the axial direction. The impeller lid 2111*a* covers the lower end surface (one axial end surface) of the impeller tubular portion 2112*a*. The plurality of blades 212*a* are disposed on the outer surface of the impeller tubular portion 2112*a* in the circumferential direction.

The impeller 21*b* includes an impeller cup 211*b* and a plurality of blades 212*b*. The impeller cup 211*b* is fixed to the motor 22. The impeller cup 211*b* includes an impeller tubular portion 2112*b* and an impeller lid 2111*b*. The impeller tubular portion 2112*b* is disposed radially outside the motor 22 of the fan 2*b*, and extends in the axial direction. The impeller lid 2111*b* covers the upper end surface (the other axial end surface) of the impeller tubular portion 2112*b*. The plurality of blades 212*b* are disposed on the outer surface of the impeller tubular portion 2112*b* in the circumferential direction.

An inclination angle of the blade 212*a* with respect to the central axis J when the impeller 21*a* disposed on the intake side is developed in the circumferential direction is smaller than an inclination angle of the blade 212*b* with respect to central axis J when the impeller 21*b* disposed on the exhaust side is developed in the circumferential direction. As a result, the air volume of the impeller 21*a* can be made larger than the air volume of the impeller 21*b* to efficiently suck air, and the blowing efficiency of the blower device 1 can be further improved. Note that the inclination angle is an attachment angle of the blade 212*a* and the blade 212*b*.

The impeller lid 2111*a* and the impeller lid 2111*b* directly face each other in the axial direction with no other member disposed therebetween. As a result, the impeller 21*a* and the impeller 21*b* are arranged close to each other in the axial direction, and it is possible to reduce the airflow from flowing into the gap between the impeller lid 2111*a* and the impeller lid 2111*b*. Accordingly, the airflow inside the housing 4 can be smoothly circulated. Therefore, the air blowing efficiency in the housing 4 can be improved.

The impeller lid 2111*a* and the impeller lid 2111*b* are disposed parallel to a plane orthogonal to the central axis J. Thus, the impeller lid 2111*a* and the impeller lid 2111*b* can be disposed closer to each other. Therefore, it is possible to further reduce the airflow from flowing into the gap between the impeller lid 2111*a* and the impeller lid 2111*b*.

The impeller lid 2111*a* has an annular impeller protrusion 2113*a* that is provided at the radially outer end portion and protrudes axially downward (one side in the axial direction) X1 (see FIG. 4). The impeller lid 2111*b* has an annular impeller protrusion 2113*b* that is provided at the radially outer end portion and protrudes axially upward (the other side in the axial direction) X2 (see FIG. 4). As a result, it is possible to further reduce the airflow from flowing into the gap between the impeller lid 2111*a* and the impeller lid 2111*b*. At least one of the impeller protrusion 2113*a* and the impeller protrusion 2113*b* may be provided in a plural number in the radial direction. As a result, it is possible to further reduce the airflow from flowing into the gap between the impeller lid 2111*a* and the impeller lid 2111*b*. The impeller protrusions 2113*a* and the impeller protrusions 2113*b* may be divided into a plurality of parts in the circumferential direction.

The impeller protrusion 2113*a* and the impeller protrusion 2113*b* face each other in the axial direction and extend in parallel with the axial direction. As a result, it is possible to suppress the turbulence of the airflow flowing along the impeller protrusion 2113*a* and the impeller protrusion 2113*b*. The impeller protrusion 2113*a* and the impeller protrusion 2113*b* may be provided in a displaced manner in the radial direction. In that case, it is preferable that the tip of one of the impeller protrusion 2113*a* and the impeller protrusion 2113*b* extends to the root side from the tip of the other one. As a result, it is possible to further reduce the airflow from flowing into the gap between the impeller lid 2111*a* and the impeller lid 2111*b*.

The outer peripheral surfaces of the impeller tubular portions 2112*a* and 2112*b* are parallel to the axial direction, and the outer diameter of the impeller tubular portion 2112*a* and the outer diameter of the impeller tubular portion 2112*b* are the same. This allows the airflow to smoothly flow from the outer peripheral surface of the impeller tubular portion 2112*a* to the outer peripheral surface of the impeller tubular portion 2112*b*. The outer peripheral surfaces of the impeller tubular portions 2112*a* and 2112*b* may be parallel to the axial direction and the outer diameter of the impeller tubular portion 2112*a* and the outer diameter of the impeller tubular portion 2112*b* may have different sizes. In addition, the outer peripheral surface of the impeller tubular portion 2112*a* and the outer peripheral surface of the impeller tubular portion 2112*b* may be formed in a truncated cone shape inclined radially outward as approaching each other in the axial direction.

FIG. 4 is a longitudinal sectional perspective view of the blower device 1. The pair of motors 22 is fixed to the lids 5*a* and 5*b*, respectively. The motor 22 on the intake side (the other side in the axial direction) X2 rotates the impeller 21*a* about the central axis J. The motor 22 on the exhaust side (one side in the axial direction) X1 rotates the impeller 21*b* about the central axis J. The motor 22 includes a shaft 221, a bearing 222, a stator 223, and a rotor 224.

The shaft 221 extends along the central axis J. The shaft 221 is, for example, a columnar member that is made of metal such as stainless steel, and extends in the axial direction.

A pair of bearings 222 is disposed to face each other at least in the axial direction. The bearing 222 is configured of a ball bearing for example, or may be configured of a sleeve bearing. The pair of bearings 222 supports the shaft 221 so as to be rotatable about the central axis J relative to the housing 4.

The stator 223 includes a bearing holder 223*a*, a stator core 223*b*, an insulator 223*c*, and a coil (not illustrated). The bearing holder 223*a* is formed in a cylindrical shape, and holds the bearing 222 inside.

An upper end portion (outer end portion in the axial direction) of the bearing holder 223*a* of the fan 2*a* is fitted in the fitting hole 511 of the lid 5*a*. As a result, the bearing holder 223*a* is fixed to the lid 5*a*, and the fan 2*a* and the lid 5*a* are fixed to each other. The bearing holder 223*a* and the lid 5*a* may be integrally formed of metal.

A lower end portion (outer end portion in the axial direction) of the bearing holder 223*a* of the fan 2*b* is fitted in the fitting hole 511 of the lid 5*b*. As a result, the bearing holder 223*a* is fixed to the lid 5*b*, and the fan 2*b* and the lid 5*b* are fixed to each other. The bearing holder 223*b* and the lid 5*b* may be integrally formed of metal.

The stator core 223*b* is formed by vertically stacking electromagnetic steel plates such as silicon steel plates. The insulator 223*c* is formed of resin having insulating properties. The insulator 223*c* is provided surrounding an outer surface of the stator core 223*b*. The coil (not illustrated) is formed of a conductive wire wound around the stator core 223*b* with the insulator 223*c* interposed between them.

The rotor 224 rotates about the central axis J with respect to the stator 223. The rotor 224 has a rotor yoke 224*a* and a magnet 224*b*.

The rotor yoke 224*a* is a substantially cylindrical member that is made of a magnetic material and has a lid on the inner side in the axial direction. The rotor yoke 224*a* of the fan 2*a* is fixed to the lower end (inner end in the axial direction) of the shaft 221. The rotor yoke 224*a* of the fan 2*b* is fixed to the upper end (inner end in the axial direction) of the shaft 221. The magnet 224*b* has a cylindrical shape and is fixed to an inner peripheral surface of the rotor yoke 224*a*. The magnet 224*b* is disposed radially outside the stator 223.

The circuit board 23 of the fan 2*a* is disposed between the stator core 223*b* and the lid 5*a*, and the circuit board 23 of the fan 2*b* is disposed between the stator core 223*b* and the lid 5*b*. The circuit board 23 has, for example, a disk shape that extends in the radial direction with the central axis J as the center. The circuit board 23 is electrically connected to a lead wire of the coil (not illustrated). An electric circuit for supplying a drive current to the coil (not illustrated) is mounted on the circuit board 23.

The circuit board 23 has an outer diameter equal to or smaller than the outer diameters of the impeller tubular portions 2112*a* and 2112*b*. As a result, the airflow inside the housing 4 can be more smoothly circulated.

When the drive current is supplied to the coil (not illustrated) of the motor 22 via the circuit board 23 in the fans 2*a* and 2*b* configured as described above, a magnetic flux in the radial direction is generated in the stator core 223*b*. A magnetic field generated by the magnetic flux of the stator core 223*b* and a magnetic field generated by the magnet 224*b* act to generate torque in the circumferential direction of the rotor 224. Due to this torque, the rotor 224 and the impellers 21*a* and 21*b* rotate about the central axis J. When the impellers 21*a* and 21*b* rotate, the plurality of blades 212*a* and 212*b* generate an airflow. As a result, the fans 2*a* and 2*b* can generate an airflow with the axially upper side (the other side in the axial direction) X1 as the intake side and the axially lower side (one side in the axial direction) X2 as the exhaust side, and blow air.

FIGS. 5 and 6 are exploded perspective views of the housing 4 and the lid 5*a*. FIG. 5 illustrates a state in which the housing 4 and the lid 5*a* are viewed from the axially upper side (the other side in the axial direction) X2. FIG. 6 illustrates a state in which the housing 4 and the lid 5*a* are viewed from the axially lower side (one side in the axial direction) X1. FIG. 7 is a perspective view of the lid 5*a*, showing a state in which the lid 5*a* is viewed from the axially lower side (one side in the axial direction) X1.

The lid 5*a* and the lid 5*b* have a fixing portion 51, a connecting portion 52, and an annular portion 53. In the present example embodiment, the lid 5*a* and the lid 5*b* have the same configurations of the fixing portion 51, the connecting portion 52, and the annular portion 53, and will be described with the same reference numerals. The fixing portion 51 is disposed radially inside the annular portion 53.

The fixing portion 51 of the lid 5*a* is disposed on the axially upper side (the other side in the axial direction) X2 of the fan 2*a*, and has a disk shape expanding in the radial direction around the central axis J. The fixing portion 51 of the lid 5*b* is disposed on the axially lower side (one side in the axial direction) X1 of the fan 2*b* and has a disk shape expanding in the radial direction around the central axis J.

The fixing portion 51 has a fitting hole 511 and an annular rib 512 (see FIG. 7). The fitting hole 511 is disposed on the central axis J and penetrates the fixing portion 51 in the axial direction. The annular rib 512 of the lid 5*a* protrudes in the axial direction from the lower surface (one axial end surface) of the fixing portion 51 and surrounds the fitting hole 511. The annular rib 512 of the lid 5*b* protrudes in the axial direction from the upper surface (the other axial end surface) of the fixing portion 51 and surrounds the fitting hole 511.

By providing the annular rib 512, the inner surface of the annular rib 512 and the bearing holder 223*a* come into contact with each other in a state where the bearing holder 223*a* is fitted into the fitting hole 511. Thus, the bearing holder 223*a* can be stably supported.

The fixing portion 51 of the lid 5*a* is formed such that the cross-sectional area orthogonal to the central axis J increases toward the axially lower side (one side in the axial direction) X1. As a result, the airflow flowing into the housing 4 from the intake port 41 smoothly flows while spreading radially outward along the peripheral surface of the fixing portion 51. This enables the further improvement of the blowing efficiency of the blower device 1.

A plurality of the connecting portions 52 extend radially outward from the fixing portion 51 and are disposed in the circumferential direction, and connect the annular portion 53 and the fixing portion 51. The air flowing inside the housing 4 passes between the adjacent connecting portions 52.

The connecting portion 52 (the connecting portion disposed on the axially lower side (one side in the axial direction) X1) of the lid 5*b* and the connecting portion 52 (the connecting portion disposed on the axially upper side (the other side in the axial direction) X2) of the lid 5*a* have different shapes. As a result, the shape of the connecting portion 52 on the intake side and the shape of the connecting portion 52 on the exhaust side are made different, and the connecting portion 52 functions as a stator vane, whereby the air blowing efficiency in the housing 4 can be improved.

The connecting portion 52 of the lid 5*a* is formed such that the cross-sectional area orthogonal to the central axis J increases toward the axially lower side (one side in the axial direction) X1. As a result, the airflow flowing into the housing 4 from the intake port 41 smoothly flows along the connecting portion 52. This enables the further improvement of the blowing efficiency of the blower device 1.

The connecting portion 52 of the lid 5*b* is inclined to one side in the circumferential direction toward the axially lower side (one side in the axial direction) X1. As a result, the airflow flowing out of the housing 4 from the exhaust port 42 smoothly flows along the connecting portion 52. This enables the further improvement of the blowing efficiency of the blower device 1.

When viewed from the radial direction, the inclination angle of the connecting portion 52 on the axially upper side (the other side in the axial direction) X2 with respect to the central axis J is smaller than the inclination angle of the connecting portion 52 on the axially lower side (one side in the axial direction) X2 with respect to the central axis J. As a result, the airflow flowing into the housing 4 from the intake port 41 can be smoothly circulated along the connecting portion 52. This enables the further improvement of the blowing efficiency of the blower device 1. The circumferential outer surface of the connecting portion 52 of the lid 5*a* may be formed in parallel with the axial direction.

The annular portion 53 is formed in an annular shape, and an outer peripheral surface of the annular portion 53 and an inner peripheral surface of the housing 4 are in contact with each other. The annular portion 53 is formed with a through hole 531 penetrating in the radial direction. The annular portion 53 includes a protruding piece 532, a groove 533, a holding piece 534, a holding recess 535, a protrusion 536, an engagement recess 537, and a cutout hole 538. The through hole 531, the protruding piece 532, the groove 533, and the engagement recess 537 are arranged in line in the axial direction.

A set of the through hole 531, the protruding piece 532, the groove 533, and the engagement recess 537 is provided at four locations at equal intervals in the circumferential direction. The protrusion 536 is disposed between the through holes 531 adjacent to each other in the circumferential direction, and is provided at four locations at equal intervals in the circumferential direction. The holding piece 534 and the holding recess 535 are provided at one location.

The protruding piece 532 of the lid 5*a* protrudes axially downward X1 from the lower surface of the annular portion 53. The through hole 531 is disposed adjacent to the protruding piece 532 in the axial direction.

The protruding piece 532 of the lid 5*b* protrudes axially upward X2 from the upper surface of the annular portion 53. That is, the protruding pieces 532 of the lids 5*a* and 5*b* protrude in the axial direction from the axial end surface facing the inside of the housing 4.

In the present example embodiment, the through hole 531 is formed across a part of the protruding piece 532. The through hole 531 may be formed only in the annular portion 53 without extending over a part of the protruding piece 532. Instead of the through hole 531, a recess recessed radially inward from the radially outer surface of the annular portion 53 may be formed.

The protruding piece 532 has an inclined portion 5321. The inclined portion 5321 of the lid 5*a* is provided on the axially lower side (side axially closer to fans 2*a*, 2*b*) X1 than the through hole 531 on the outer peripheral surface of the protruding piece 532, and is inclined radially outward toward the axially upper side (axially outer side of the housing 4) X2.

The inclined portion 5321 of the lid 5*b* is arranged on the axially upper side (side axially closer to the fans 2*a*, 2*b*) X2 than the through hole 531 on the outer peripheral surface of the protruding piece 532, and is inclined radially outward toward the axially lower side (axially outer side of the housing 4) X1.

The groove 533 of the lid 5*a* is recessed radially inward from the outer peripheral surface and extends axially at the lower end of the protruding piece 532 (an end in the axial direction facing the inside of the housing 4).

The groove 533 of the lid 5*b* is recessed radially inward from the outer peripheral surface and extends axially at the upper end of the protruding piece 532 (an end in the axial direction facing the inside of the housing 4).

The engagement recess 537 of the lid 5*a* is provided on the axially upper side of the through hole 531 (side axially farther from the fans 2*a*, 2*b* than the through hole 531) X2 and is recessed radially inward from the outer peripheral surface of the annular portion 53.

The engagement recess 537 of the lid 5*b* is provided on the axially lower side of the through hole 531 (side axially farther from the fans 2*a*, 2*b* than the through hole 531) X1 and is recessed radially inward from the outer peripheral surface of the annular portion 53.

The holding piece 534 protrudes radially outward from the outer peripheral surface of the annular portion 53 and extends in the circumferential direction. The holding recess 535 radially faces the holding piece 534 and is recessed radially inward from the outer peripheral surface of the annular portion 53.

The cutout hole 538 is provided radially opposite to a cutout recess 48 and a holding piece 534 of the housing 4 described later. The cutout hole 538 of the lid 5*a* is formed by being cut out axially upward (axial direction) X2 from an end surface of the annular portion 53 facing the inside of the housing 4. The cutout hole 538 of the lid 5*b* is formed by being cut out axially downward (axial direction) X1 from an end surface of the annular portion 53 facing the inside of the housing 4.

A conductive wire (not illustrated) connected to the circuit board 23 of the fan 2*a* and a conductive wire (not illustrated) connected to the circuit board 23 of the fan 2*b* are drawn out to the outside of the housing 4 through the cutout holes 538, respectively. Accordingly, the conductive wire can be prevented from coming into contact with the impeller 21*a* or the impeller 21*b*. Further, by reducing the number of conductive wires passing through the inside of the housing 4, the airflow inside the housing 4 can be more smoothly circulated.

In addition, the drawn conductive wire is held between the holding piece 534 and the holding recess 535. As a result, the conductive wire drawn out to the outside of the housing 4 can be held along the outer peripheral surface of the housing 4. Therefore, the conductive wire is easily routed, and the assembling workability of the blower device 1 is further improved.

The housing 4 has an engagement protrusion 44, a guide portion 45, a flange portion 46, a cutout portion 47, a cutout recess 48, and a stepped portion 49 at each of the lower end (one axial end) and the upper end (the other axial end). The engagement protrusion 44, the guide portion 45, and the cutout portion 47 are arranged in a line in the axial direction. A set of the engagement protrusion 44, the guide portion 45, and the cutout portion 47 is provided at four locations at equal intervals in the circumferential direction at the upper end and the lower end of the housing 4, respectively. The cutout recess 48 is provided in the middle of the engagement protrusions 44 adjacent to each other in the circumferential direction, and is provided at four locations at equal intervals in the circumferential direction at the upper end and the lower end of the housing 4, respectively.

The stepped portion 49 is formed such that the inner peripheral surface is recessed radially outward at both axial ends of the housing 4. The stepped portion 49 contacts the annular portion 53 in the axial direction. By providing the stepped portion 49, the inner peripheral surface of the annular portion 53 and the inner peripheral surface of the housing 4 are formed to be flush with each other. As a result, the airflow inside the housing 4 can be more smoothly circulated.

The engagement protrusions 44 protrude radially inward from inner peripheral surfaces of both axial end portions of the housing 4, respectively. The engagement protrusion 44 is engaged with the periphery of the through hole 531 of the lid 5*a* at the upper end portion of the housing 4. The engagement protrusion 44 is engaged with the periphery of the through hole 531 of the lid 5*b* at the lower end portion of the housing 4.

The guide portion 45 is provided at the axially outer end portion. The guide portion 45 is provided on the axially upper side (outer side in the axial direction) X2 than the engagement protrusion 44 at the upper end portion (the other end in the axial direction) of the housing 4. The guide portion 45 is provided on the axially lower side (outer side in the axial direction) X1 than the engagement protrusion 44 at the lower end portion (one end in the axial direction) of the housing 4. The guide portion 45 protrudes radially inward from the inner peripheral surface of the housing 4 and extends in the axial direction.

The cutout portion 47 is provided on the axially lower side (inner side in the axial direction) X1 than the engagement protrusion 44 at the upper end portion (the other end in the axial direction) of the housing 4, and the stepped portion 49 is formed to be recessed axially downward (inward in the axial direction) X1. The cutout portion 47 is provided on the axially upper side (inner side in the axial direction) X2 than the engagement protrusion 44 at the lower end portion (the other end in the axial direction) of the housing 4, and the stepped portion 49 is formed to be recessed axially upward (inward in the axial direction) X2.

The flange portion 46 protrudes radially outward from the axially outer end portion of the housing 4, and is formed with an attachment hole 461 extending in the axial direction. The blower device 1 is screwed to another device via the attachment hole 461. The flange portion 46 faces the engagement protrusion 44 in the radial direction, and is provided at four locations in each of the upper end portion and the lower end portion of the housing 4. The engagement protrusion 44 and the guide portion 45 are adjacent to the attachment hole 461 in the radial direction. Thus, the periphery of the attachment hole 461 can be formed thick.

The cutout recesses 48 is provided at four locations in each of the upper end portion and the lower end portion of the housing 4. The cutout recess 48 is formed by being cut out axially downward (one side in the axial direction) X1 from the axially upper end surface (the other axial end surface) at the upper end portion of the housing 4. The cutout recess 48 is formed by being cut out axially upward (the other side in the axial direction) X2 from the axially lower end surface (one axial end surface) at the lower end portion of the housing 4.

FIG. 8 is an enlarged perspective view illustrating a part of an upper end portion of the blower device 1. The lid 5*a* is attached to the housing 4 in a state where the fan 2*a* is fixed. At this time, the groove 533 of the protruding piece 532 is brought into contact with the guide portion 45, and the lid 5*a* is inserted into the axially lower side (one side in the axial direction) X1.

The lid 5*b* is attached to the housing 4 in a state where the fan 2*b* is fixed. At this time, the groove 533 of the protruding piece 532 is brought into contact with the guide portion 45, and the lid 5*a* is inserted into the axially upper side (the other side in the axial direction) X2.

At this time, the guide portion 45 slides along the groove 533. This facilitates circumferential positioning of the lids 5*a* and 5*b*, and allows the lids 5*a* and 5*b* to be smoothly inserted inward in the axial direction.

When the engagement protrusion 44 comes into contact with the inclined portion 5321, the protruding piece 532 bends radially inward, and the lids 5*a* and 5*b* are inserted axially inward, whereby the engagement protrusion 44 is inserted into the through hole 531. As a result, the engagement protrusion 44 is engaged with the periphery of the through hole 531, and the protruding piece 532 presses the inner peripheral surface of the housing 4 radially outward. Accordingly, the lids 5*a* and 5*b* are firmly fixed to the housing 4. Therefore, the workability of assembling the lids 5*a* and 5*b* and the housing 4 can be improved.

At this time, by providing the inclined portion 5321, the protruding piece 532 can be easily moved along the guide portion 45. Therefore, the workability of assembling the lid 5*a* and the housing 4 can be further improved.

In addition, the protruding piece 532 is fitted into the cutout portion 47 in a state where the engagement protrusion 44 is engaged with the periphery of the through hole 531. The protrusion 536 is fitted into the cutout recess 48. Further, the guide portion 45 is fitted into the engagement recess 537. The annular portion 53 is in contact with the stepped portion 49 in the axial direction. In addition, a plurality of sets of the through holes 531 and the engagement protrusions 44 to be engaged are arranged at substantially equal intervals in the circumferential direction. As a result, the housing 4 and the lid 5*a* are more firmly fixed in the axial direction and the circumferential direction.

Note that a gap may be partially formed between the outer peripheral surface of the annular portion 53 and the inner peripheral surface of the housing 4. As a result, vibration transmitted from the lids 5*a* and 5*b* to the housing 4 can be reduced.

While preferred example embodiments of the present disclosure have been described above, it will be understood that the scope of the present disclosure is not limited to the above-described example embodiments, and that various modifications may be made to the above-described example embodiments without departing from the gist of the present disclosure. In addition, features of the above-described example embodiments and the modifications thereof may be combined appropriately as desired.

In the present example embodiment, a set of the through hole 531, the protruding piece 532, the groove 533, and the engagement recess 537, and a set of the engagement protrusion 44, the guide portion 45, and the cutout portion 47 are provided at four locations at equal intervals in the circumferential direction, but may be provided at two locations, three locations, or five or more locations.

Although the engagement protrusion 44 and the guide portion 45 are disposed adjacent to the attachment hole 461 in the radial direction, the engagement protrusion 44 and the guide portion 45 may be disposed at positions different from the attachment hole 461 in the circumferential direction. Further, the engagement protrusion 44 may be disposed at a position different from the guide portion 45 in the circumferential direction.

In addition, the housing 4 may be formed to have a diameter that decreases toward the axially lower side (one side in the axial direction). As a result, the airflow inside the housing 4 can be more smoothly circulated toward the exhaust side.

Hereinafter, example embodiments of a third disclosure will be described in detail with reference to the accompanying drawings.

(1)

A blower device includes a pair of fans that generates an airflow on one side in an axial direction along a central axis, the pair of fans being coaxially disposed;

a housing formed in a tubular shape and extending along the central axis, the housing accommodating the pair of fans, both axial end faces of the housing being opened; and a lid that covers each of one axial end surface and another axial end surface of the housing, and ventilates, and the material constituting the lid is different from the material constituting the housing.

(2)

The Young's modulus of the material constituting the lid is higher than the Young's modulus of the material constituting the housing.

(3)

The lid includes an annular portion in an annular shape that is in contact with an inner peripheral surface of the housing, a fixing portion which is disposed on a radially inner side of the annular portion and to which the fan is fixed, and a connecting portion that extends radially outward from the fixing portion, a plurality of the connecting portions being disposed in a circumferential direction and connecting the annular portion and the fixing portion.

A gap is formed between the outer peripheral surface of the annular portion and the inner peripheral surface of the housing facing in the radial direction.

(4)

The housing includes a guide portion provided at an axially outer end portion and protruding radially inward from the inner peripheral surface and extending in the axial direction.

The annular portion includes an engagement recess that is recessed radially inward from the outer peripheral surface and into which the guide portion is fitted.

(5)

The housing includes a flange portion protruding radially outward from an axially outer end portion.

The flange portion includes an attachment hole extending in the axial direction, and the guide portion is radially adjacent to the attachment hole.

(6)

The annular portion includes a through hole penetrating in the radial direction.

The housing includes an engagement protrusion that protrudes radially inward from the inner peripheral surface and engages with the periphery of the through hole, and the engagement protrusion is provided at a position different from the guide portion in the circumferential direction.

(7)

The housing includes a cutout recess formed by being cut out axially inward from an axially outer end surface, the annular portion has a cutout hole formed by being cut out in the axial direction from an axial end surface facing the inside of the housing, and the cutout recess and the cutout hole face each other in the radial direction, and a conductive wire connected to the fan is drawn out of the housing through the cutout recess and the cutout hole.

(8)

The pair of fans includes:

a motor that is fixed to each of the lids and rotates an impeller; and a circuit board disposed between the impeller and the lid in the axial direction and connected to the motor.

The impeller includes:

an impeller tubular portion disposed on a radially outer side of the motor and extending in an axial direction;

an impeller lid that covers an axial end surface of the impeller tubular portion on a side axially opposite to the lid to which the motor is fixed; and a plurality of blades arranged in a circumferential direction on a radially outer surface of the impeller tubular portion.

The size of the outer diameter of the circuit board is equal to or smaller than the size of the outer diameter of the impeller tubular portion.

(9)

The lid is made of polyphenylene sulfide or polybutylene terephthalate, and the housing is made of polyphenylene ether.

(10)

The lid part is made of polyphenylene sulfide, and the housing is made of polybutylene terephthalate.

FIG. 1 is an overall perspective view of an example of the blower device 1 according to an example embodiment of the present disclosure, and FIG. 2 is an exploded perspective view of the blower device 1. The blower device 1 includes a pair of fans 2*a* and 2*b*, a housing 4, and lids 5*a* and 5*b*.

The fans 2*a* and 2*b* generate an airflow on the axially lower side (one side in the axial direction) X1 along the central axis J, and are coaxially disposed. The fan 2*a* is disposed on the intake side, and includes an impeller 21*a*, a motor 22, and a circuit board 23. The fan 2*b* is disposed on the exhaust side, and includes an impeller 21*b*, a motor 22, and a circuit board 23. In the present example embodiment, the fan 2*a* and the fan 2*b* have the same configurations of the motor 22 and the circuit board 23, and are described with the same reference numerals.

The housing 4 is formed in a tubular shape extending along the central axis J, accommodates the pair of fans 2*a* and 2*b*, and has both end surfaces opened in the axial direction. The housing 4 includes an airflow passage in which the air flows inside. The housing 4 has an exhaust port 42 on the lower end surface (one axial end surface) and an intake port 41 on the upper end side (the other axial end surface).

The lid 5*a* covers the intake port 41 (the other axial end surface) of the housing 4, and ventilates. The lid 5*b* covers the exhaust port 42 (one axial end surface) of the housing 4, and ventilates. The fan 2*a* is fixed to the lid 5*a*, and the fan 2*b* is fixed to the lid 5*b*.

The lids 5*a* and 5*b* and the housing 4 are resin molded members, and the material constituting the lids 5*a* and 5*b* is different from the material constituting the housing 4. Specifically, the Young's modulus of the material constituting the lids 5*a* and 5*b* is higher than the Young's modulus of the material constituting the housing 4. As a result, it is possible to make the vibration frequency of the lids 5*a* and 5*b* and the vibration frequency of the housing 4 different. Therefore, resonance of the lids 5*a* and 5*b* and the housing 4 can be reduced. Thus, vibration of the blower device 1 can be reduced.

Specifically, when polyphenylene sulfide or polybutylene terephthalate is used as the material constituting the lids 5*a* and 5*b*, polyphenylene ether can be suitably used as the material constituting the housing 4. Meanwhile, when polyphenylene sulfide is used as the material constituting the lids 5*a* and 5*b*, polybutylene terephthalate can be suitably used as the material constituting the housing 4. By using these materials, it is possible to further reduce the vibration of the blower device 1 while maintaining the strength of the lids 5*a* and 5*b* and the housing 4.

FIG. 3 is a side view of the blower device 1. In FIG. 3, the housing 4 is omitted. The impeller 21*a* is disposed radially outside the motor 22 and is rotated about the central axis J by the motor 22. The impeller 21*b* is disposed radially outside the motor 22 and is rotated about the central axis J by the motor 22. The rotation direction of the impeller 21*a* is opposite to the rotation direction of the impeller 21*b*. Depending on the shapes of the impellers 21*a* and 21*b*, the rotation direction of the impeller 21*a* and the rotation direction of the impeller 21*b* may be the same.

The impeller 21*a* includes an impeller cup 211*a* and a plurality of blades 212*a*. The impeller cup 211*a* is fixed to the motor 22. The impeller cup 211*a* includes an impeller tubular portion 2112*a* and an impeller lid 2111*a*. The impeller tubular portion 2112*a* is disposed radially outside the motor 22 of the fan 2*a*, and extends in the axial direction. The impeller lid 2111*a* covers the lower end surface (one axial end surface) of the impeller tubular portion 2112*a*. The plurality of blades 212*a* are disposed on the outer surface of the impeller tubular portion 2112*a* in the circumferential direction.

The impeller 21*b* includes an impeller cup 211*b* and a plurality of blades 212*b*. The impeller cup 211*b* is fixed to the motor 22. The impeller cup 211*b* includes an impeller tubular portion 2112*b* and an impeller lid 2111*b*. The impeller tubular portion 2112*b* is disposed radially outside the motor 22 of the fan 2*b*, and extends in the axial direction. The impeller lid 2111*b* covers the upper end surface (the other axial end surface) of the impeller tubular portion 2112*b*. The plurality of blades 212*b* are disposed on the outer surface of the impeller tubular portion 2112*b* in the circumferential direction.

An inclination angle of the blade 212*a* with respect to the central axis J when the impeller 21*a* disposed on the intake side is developed in the circumferential direction is smaller than an inclination angle of the blade 212*b* with respect to central axis J when the impeller 21*b* disposed on the exhaust side is developed in the circumferential direction. As a result, the air volume of the impeller 21*a* can be made larger than the air volume of the impeller 21*b* to efficiently suck air, and the blowing efficiency of the blower device 1 can be further improved. Note that the inclination angle is an attachment angle of the blade 212*a* and the blade 212*b*.

The impeller lid 2111*a* and the impeller lid 2111*b* directly face each other in the axial direction with no other member disposed therebetween. As a result, the impeller 21*a* and the impeller 21*b* are arranged close to each other in the axial direction, and it is possible to reduce the airflow from flowing into the gap between the impeller lid 2111*a* and the impeller lid 2111*b*. Accordingly, the airflow inside the housing 4 can be smoothly circulated. Therefore, the air blowing efficiency in the housing 4 can be improved.

The impeller lid 2111*a* and the impeller lid 2111*b* are disposed parallel to a plane orthogonal to the central axis J. Thus, the impeller lid 2111*a* and the impeller lid 2111*b* can be disposed closer to each other. Therefore, it is possible to further reduce the airflow from flowing into the gap between the impeller lid 2111*a* and the impeller lid 2111*b*.

The impeller lid 2111*a* has an annular impeller protrusion 2113*a* that is provided at the radially outer end portion and protrudes axially downward (one side in the axial direction) X1 (see FIG. 4). The impeller lid 2111*b* has an annular impeller protrusion 2113*b* that is provided at the radially outer end portion and protrudes axially upward (the other side in the axial direction) X2 (see FIG. 4). As a result, it is possible to further reduce the airflow from flowing into the gap between the impeller lid 2111*a* and the impeller lid 2111*b*. At least one of the impeller protrusion 2113*a* and the impeller protrusion 2113*b* may be provided in a plural number in the radial direction. As a result, it is possible to further reduce the airflow from flowing into the gap between the impeller lid 2111*a* and the impeller lid 2111*b*. The impeller protrusions 2113*a* and the impeller protrusions 2113*b* may be divided into a plurality of parts in the circumferential direction.

The impeller protrusion 2113*a* and the impeller protrusion 2113*b* face each other in the axial direction and extend in parallel with the axial direction. As a result, it is possible to suppress the turbulence of the airflow flowing along the impeller protrusion 2113*a* and the impeller protrusion 2113*b*. The impeller protrusion 2113*a* and the impeller protrusion 2113*b* may be provided in a displaced manner in the radial direction. In that case, it is preferable that the tip of one of the impeller protrusion 2113*a* and the impeller protrusion 2113*b* extends to the root side from the tip of the other one. As a result, it is possible to further reduce the airflow from flowing into the gap between the impeller lid 2111*a* and the impeller lid 2111*b*.

The outer peripheral surfaces of the impeller tubular portions 2112*a* and 2112*b* are parallel to the axial direction, and the outer diameter of the impeller tubular portion 2112*a* and the outer diameter of the impeller tubular portion 2112*b* are the same. This allows the airflow to smoothly flow from the outer peripheral surface of the impeller tubular portion 2112*a* to the outer peripheral surface of the impeller tubular portion 2112*b*. The outer peripheral surfaces of the impeller tubular portions 2112*a* and 2112*b* may be parallel to the axial direction and the outer diameter of the impeller tubular portion 2112*a* and the outer diameter of the impeller tubular portion 2112*b* may have different sizes. In addition, the outer peripheral surface of the impeller tubular portion 2112*a* and the outer peripheral surface of the impeller tubular portion 2112*b* may be formed in a truncated cone shape inclined radially outward as approaching each other in the axial direction.

FIG. 4 is a longitudinal sectional perspective view of the blower device 1. The pair of motors 22 is fixed to the lids 5*a* and 5*b*, respectively. The motor 22 on the intake side (the other side in the axial direction) X2 rotates the impeller 21*a* about the central axis J. The motor 22 on the exhaust side (one side in the axial direction) X1 rotates the impeller 21*b* about the central axis J. The motor 22 includes a shaft 221, a bearing 222, a stator 223, and a rotor 224.

The shaft 221 extends along the central axis J. The shaft 221 is, for example, a columnar member that is made of metal such as stainless steel, and extends in the axial direction.

A pair of bearings 222 is disposed to face each other at least in the axial direction. The bearing 222 is configured of a ball bearing for example, or may be configured of a sleeve bearing. The pair of bearings 222 supports the shaft 221 so as to be rotatable about the central axis J relative to the housing 4.

The stator 223 includes a bearing holder 223*a*, a stator core 223*b*, an insulator 223*c*, and a coil (not illustrated). The bearing holder 223*a* is formed in a cylindrical shape, and holds the bearing 222 inside.

An upper end portion (outer end portion in the axial direction) of the bearing holder 223*a* of the fan 2*a* is fitted in the fitting hole 511 of the lid 5*a*. As a result, the bearing holder 223*a* is fixed to the lid 5*a*, and the fan 2*a* and the lid 5*a* are fixed to each other. The bearing holder 223*a* and the lid 5*a* may be integrally formed of metal.

A lower end portion (outer end portion in the axial direction) of the bearing holder 223*a* of the fan 2*b* is fitted in the fitting hole 511 of the lid 5*b*. As a result, the bearing holder 223*a* is fixed to the lid 5*b*, and the fan 2*b* and the lid 5*b* are fixed to each other. The bearing holder 223*b* and the lid 5*b* may be integrally formed of metal.

The stator core 223*b* is formed by vertically stacking electromagnetic steel plates such as silicon steel plates. The insulator 223*c* is formed of resin having insulating properties. The insulator 223*c* is provided surrounding an outer surface of the stator core 223*b*. The coil (not illustrated) is formed of a conductive wire wound around the stator core 223*b* with the insulator 223*c* interposed between them.

The rotor 224 rotates about the central axis J with respect to the stator 223. The rotor 224 has a rotor yoke 224*a* and a magnet 224*b*.

The rotor yoke 224*a* is a substantially cylindrical member that is made of a magnetic material and has a lid on the inner side in the axial direction. The rotor yoke 224*a* of the fan 2*a* is fixed to the lower end (inner end in the axial direction) of the shaft 221. The rotor yoke 224*a* of the fan 2*b* is fixed to the upper end (inner end in the axial direction) of the shaft 221. The magnet 224*b* has a cylindrical shape and is fixed to an inner peripheral surface of the rotor yoke 224*a*. The magnet 224*b* is disposed radially outside the stator 223.

The circuit board 23 of the fan 2*a* is disposed between the stator core 223*b* and the lid 5*a*, and the circuit board 23 of the fan 2*b* is disposed between the stator core 223*b* and the lid 5*b*. The circuit board 23 has, for example, a disk shape that extends in the radial direction with the central axis J as the center. The circuit board 23 is electrically connected to a lead wire of the coil (not illustrated). An electric circuit for supplying a drive current to the coil (not illustrated) is mounted on the circuit board 23.

The circuit board 23 has an outer diameter equal to or smaller than the outer diameters of the impeller tubular portions 2112*a* and 2112*b*. As a result, the airflow inside the housing 4 can be more smoothly circulated.

When the drive current is supplied to the coil (not illustrated) of the motor 22 via the circuit board 23 in the fans 2*a* and 2*b* configured as described above, a magnetic flux in the radial direction is generated in the stator core 223*b*. A magnetic field generated by the magnetic flux of the stator core 223*b* and a magnetic field generated by the magnet 224*b* act to generate torque in the circumferential direction of the rotor 224. Due to this torque, the rotor 224 and the impellers 21*a* and 21*b* rotate about the central axis J. When the impellers 21*a* and 21*b* rotate, the plurality of blades 212*a* and 212*b* generate an airflow. As a result, the fans 2*a* and 2*b* can generate an airflow with the axially upper side (the other side in the axial direction) X1 as the intake side and the axially lower side (one side in the axial direction) X2 as the exhaust side, and blow air.

FIGS. 5 and 6 are exploded perspective views of the housing 4 and the lid 5*a*. FIG. 5 illustrates a state in which the housing 4 and the lid 5*a* are viewed from the axially upper side (the other side in the axial direction) X2. FIG. 6 illustrates a state in which the housing 4 and the lid 5*a* are viewed from the axially lower side (one side in the axial direction) X1. FIG. 7 is a perspective view of the lid 5*a*, showing a state in which the lid 5*a* is viewed from the axially lower side (one side in the axial direction) X1.

The lid 5*a* and the lid 5*b* have a fixing portion 51, a connecting portion 52, and an annular portion 53. In the present example embodiment, the lid 5*a* and the lid 5*b* have the same configurations of the fixing portion 51, the connecting portion 52, and the annular portion 53, and will be described with the same reference numerals. The fixing portion 51 is disposed radially inside the annular portion 53.

The fixing portion 51 of the lid 5*a* is disposed on the axially upper side (the other side in the axial direction) X2 of the fan 2*a*, and has a disk shape expanding in the radial direction around the central axis J. The fixing portion 51 of the lid 5*b* is disposed on the axially lower side (one side in the axial direction) X1 of the fan 2*b* and has a disk shape expanding in the radial direction around the central axis J.

The fixing portion 51 has a fitting hole 511 and an annular rib 512 (see FIG. 7). The fitting hole 511 is disposed on the central axis J and penetrates the fixing portion 51 in the axial direction. The annular rib 512 of the lid 5*a* protrudes in the axial direction from the lower surface (one axial end surface) of the fixing portion 51 and surrounds the fitting hole 511. The annular rib 512 of the lid 5*b* protrudes in the axial direction from the upper surface (the other axial end surface) of the fixing portion 51 and surrounds the fitting hole 511.

By providing the annular rib 512, the inner surface of the annular rib 512 and the bearing holder 223*a* come into contact with each other in a state where the bearing holder 223*a* is fitted into the fitting hole 511. Thus, the bearing holder 223*a* can be stably supported.

The fixing portion 51 of the lid 5*a* is formed such that the cross-sectional area orthogonal to the central axis J increases toward the axially lower side (one side in the axial direction) X1. As a result, the airflow flowing into the housing 4 from the intake port 41 smoothly flows while spreading radially outward along the peripheral surface of the fixing portion 51. This enables the further improvement of the blowing efficiency of the blower device 1.

A plurality of the connecting portions 52 extend radially outward from the fixing portion 51 and are disposed in the circumferential direction, and connect the annular portion 53 and the fixing portion 51. The air flowing inside the housing 4 passes between the adjacent connecting portions 52.

The connecting portion 52 (the connecting portion disposed on the axially lower side (one side in the axial direction) X1) of the lid 5*b* and the connecting portion 52 (the connecting portion disposed on the axially upper side (the other side in the axial direction) X2) of the lid 5*a* have different shapes. As a result, the shape of the connecting portion 52 on the intake side and the shape of the connecting portion 52 on the exhaust side are made different, and the connecting portion 52 functions as a stator vane, whereby the air blowing efficiency in the housing 4 can be improved.

The connecting portion 52 of the lid 5*a* is formed such that the cross-sectional area orthogonal to the central axis J increases toward the axially lower side (one side in the axial direction) X1. As a result, the airflow flowing into the housing 4 from the intake port 41 smoothly flows along the connecting portion 52. This enables the further improvement of the blowing efficiency of the blower device 1.

The connecting portion 52 of the lid 5*b* is inclined to one side in the circumferential direction toward the axially lower side (one side in the axial direction) X1. As a result, the airflow flowing out of the housing 4 from the exhaust port 42 smoothly flows along the connecting portion 52. This enables the further improvement of the blowing efficiency of the blower device 1.

When viewed from the radial direction, the inclination angle of the connecting portion 52 on the axially upper side (the other side in the axial direction) X2 with respect to the central axis J is smaller than the inclination angle of the connecting portion 52 on the axially lower side (one side in the axial direction) X2 with respect to the central axis J. As a result, the airflow flowing into the housing 4 from the intake port 41 can be smoothly circulated along the connecting portion 52. This enables the further improvement of the blowing efficiency of the blower device 1. The circumferential outer surface of the connecting portion 52 of the lid 5*a* may be formed in parallel with the axial direction.

The annular portion 53 is formed in an annular shape, and an outer peripheral surface of the annular portion 53 and an inner peripheral surface of the housing 4 are in contact with each other. The annular portion 53 is formed with a through hole 531 penetrating in the radial direction. The annular portion 53 includes a protruding piece 532, a groove 533, a holding piece 534, a holding recess 535, a protrusion 536, an engagement recess 537, and a cutout hole 538. The through hole 531, the protruding piece 532, the groove 533, and the engagement recess 537 are arranged in line in the axial direction.

A set of the through hole 531, the protruding piece 532, the groove 533, and the engagement recess 537 is provided at four locations at equal intervals in the circumferential direction. The protrusion 536 is disposed between the through holes 531 adjacent to each other in the circumferential direction, and is provided at four locations at equal intervals in the circumferential direction. The holding piece 534 and the holding recess 535 are provided at one location.

The protruding piece 532 of the lid 5*a* protrudes axially downward X1 from the lower surface of the annular portion 53. The through hole 531 is disposed adjacent to the protruding piece 532 in the axial direction.

The protruding piece 532 of the lid 5*b* protrudes axially upward X2 from the upper surface of the annular portion 53. That is, the protruding pieces 532 of the lids 5*a* and 5*b* protrude in the axial direction from the axial end surface facing the inside of the housing 4.

In the present example embodiment, the through hole 531 is formed across a part of the protruding piece 532. The through hole 531 may be formed only in the annular portion 53 without extending over a part of the protruding piece 532. Instead of the through hole 531, a recess recessed radially inward from the radially outer surface of the annular portion 53 may be formed.

The protruding piece 532 has an inclined portion 5321. The inclined portion 5321 of the lid 5*a* is provided on the axially lower side (side axially closer to fans 2*a*, 2*b*) X1 than the through hole 531 on the outer peripheral surface of the protruding piece 532, and is inclined radially outward toward the axially upper side (axially outer side of the housing 4) X2.

The inclined portion 5321 of the lid 5*b* is arranged on the axially upper side (side axially closer to the fans 2*a*, 2*b*) X2 than the through hole 531 on the outer peripheral surface of the protruding piece 532, and is inclined radially outward toward the axially lower side (axially outer side of the housing 4) X1.

The groove 533 of the lid 5*a* is recessed radially inward from the outer peripheral surface and extends axially at the lower end of the protruding piece 532 (an end in the axial direction facing the inside of the housing 4).

The groove 533 of the lid 5*b* is recessed radially inward from the outer peripheral surface and extends axially at the upper end of the protruding piece 532 (an end in the axial direction facing the inside of the housing 4).

The engagement recess 537 of the lid 5*a* is provided on the axially upper side of the through hole 531 (side axially farther from the fans 2*a*, 2*b* than the through hole 531) X2 and is recessed radially inward from the outer peripheral surface of the annular portion 53.

The engagement recess 537 of the lid 5*b* is provided on the axially lower side of the through hole 531 (side axially farther from the fans 2*a*, 2*b* than the through hole 531) X1 and is recessed radially inward from the outer peripheral surface of the annular portion 53.

The holding piece 534 protrudes radially outward from the outer peripheral surface of the annular portion 53 and extends in the circumferential direction. The holding recess 535 radially faces the holding piece 534 and is recessed radially inward from the outer peripheral surface of the annular portion 53.

The cutout hole 538 is provided radially opposite to a cutout recess 48 and a holding piece 534 of the housing 4 described later. The cutout hole 538 of the lid 5*a* is formed by being cut out axially upward (axial direction) X2 from an end surface of the annular portion 53 facing the inside of the housing 4. The cutout hole 538 of the lid 5*b* is formed by being cut out axially downward (axial direction) X1 from an end surface of the annular portion 53 facing the inside of the housing 4.

A conductive wire (not illustrated) connected to the circuit board 23 of the fan 2*a* and a conductive wire (not illustrated) connected to the circuit board 23 of the fan 2*b* are drawn out to the outside of the housing 4 through the cutout holes 538, respectively. Accordingly, the conductive wire can be prevented from coming into contact with the impeller 21*a* or the impeller 21*b*. Further, by reducing the number of conductive wires passing through the inside of the housing 4, the airflow inside the housing 4 can be more smoothly circulated.

In addition, the drawn conductive wire is held between the holding piece 534 and the holding recess 535. As a result, the conductive wire drawn out to the outside of the housing 4 can be held along the outer peripheral surface of the housing 4. Therefore, the conductive wire is easily routed, and the assembling workability of the blower device 1 is further improved.

The housing 4 has an engagement protrusion 44, a guide portion 45, a flange portion 46, a cutout portion 47, a cutout recess 48, and a stepped portion 49 at each of the lower end (one axial end) and the upper end (the other axial end). The engagement protrusion 44, the guide portion 45, and the cutout portion 47 are arranged in a line in the axial direction. A set of the engagement protrusion 44, the guide portion 45, and the cutout portion 47 is provided at four locations at equal intervals in the circumferential direction at the upper end and the lower end of the housing 4, respectively. The cutout recess 48 is provided in the middle of the engagement protrusions 44 adjacent to each other in the circumferential direction, and is provided at four locations at equal intervals in the circumferential direction at the upper end and the lower end of the housing 4, respectively.

The stepped portion 49 is formed such that the inner peripheral surface is recessed radially outward at both axial ends of the housing 4. The stepped portion 49 contacts the annular portion 53 in the axial direction. By providing the stepped portion 49, the inner peripheral surface of the annular portion 53 and the inner peripheral surface of the housing 4 are formed to be flush with each other. As a result, the airflow inside the housing 4 can be more smoothly circulated.

The engagement protrusions 44 protrude radially inward from inner peripheral surfaces of both axial end portions of the housing 4, respectively. The engagement protrusion 44 is engaged with the periphery of the through hole 531 of the lid 5*a* at the upper end portion of the housing 4. The engagement protrusion 44 is engaged with the periphery of the through hole 531 of the lid 5*b* at the lower end portion of the housing 4.

The guide portion 45 is provided at the axially outer end portion. The guide portion 45 is provided on the axially upper side (outer side in the axial direction) X2 than the engagement protrusion 44 at the upper end portion (the other end in the axial direction) of the housing 4. The guide portion 45 is provided on the axially lower side (outer side in the axial direction) X1 than the engagement protrusion 44 at the lower end portion (one end in the axial direction) of the housing 4. The guide portion 45 protrudes radially inward from the inner peripheral surface of the housing 4 and extends in the axial direction.

The cutout portion 47 is provided on the axially lower side (inner side in the axial direction) X1 than the engagement protrusion 44 at the upper end portion (the other end in the axial direction) of the housing 4, and the stepped portion 49 is formed to be recessed axially downward (inward in the axial direction) X1. The cutout portion 47 is provided on the axially upper side (inner side in the axial direction) X2 than the engagement protrusion 44 at the lower end portion (the other end in the axial direction) of the housing 4, and the stepped portion 49 is formed to be recessed axially upward (inward in the axial direction) X2.

The flange portion 46 protrudes radially outward from the axially outer end portion of the housing 4, and is formed with an attachment hole 461 extending in the axial direction. The blower device 1 is screwed to another device via the attachment hole 461. The flange portion 46 faces the engagement protrusion 44 in the radial direction, and is provided at four locations in each of the upper end portion and the lower end portion of the housing 4. The engagement protrusion 44 and the guide portion 45 are adjacent to the attachment hole 461 in the radial direction. Thus, the periphery of the attachment hole 461 can be formed thick.

The cutout recesses 48 is provided at four locations in each of the upper end portion and the lower end portion of the housing 4. The cutout recess 48 is formed by being cut out axially downward (one side in the axial direction) X1 from the axially upper end surface (the other axial end surface) at the upper end portion of the housing 4. The cutout recess 48 is formed by being cut out axially upward (the other side in the axial direction) X2 from the axially lower end surface (one axial end surface) at the lower end portion of the housing 4.

FIG. 8 is an enlarged perspective view illustrating a part of an upper end portion of the blower device 1. The lid 5*a* is attached to the housing 4 in a state where the fan 2*a* is fixed. At this time, the groove 533 of the protruding piece 532 is brought into contact with the guide portion 45, and the lid 5*a* is inserted into the axially lower side (one side in the axial direction) X1.

The lid 5*b* is attached to the housing 4 in a state where the fan 2*b* is fixed. At this time, the groove 533 of the protruding piece 532 is brought into contact with the guide portion 45, and the lid 5*a* is inserted into the axially upper side (the other side in the axial direction) X2.

At this time, the guide portion 45 slides along the groove 533. This facilitates circumferential positioning of the lids 5*a* and 5*b*, and allows the lids 5*a* and 5*b* to be smoothly inserted inward in the axial direction.

When the engagement protrusion 44 comes into contact with the inclined portion 5321, the protruding piece 532 bends radially inward, and the lids 5*a* and 5*b* are inserted axially inward, whereby the engagement protrusion 44 is inserted into the through hole 531. As a result, the engagement protrusion 44 is engaged with the periphery of the through hole 531, and the protruding piece 532 presses the inner peripheral surface of the housing 4 radially outward. Accordingly, the lids 5*a* and 5*b* are firmly fixed to the housing 4. Therefore, the workability of assembling the lids 5*a* and 5*b* and the housing 4 can be improved.

At this time, by providing the inclined portion 5321, the protruding piece 532 can be easily moved along the guide portion 45. Therefore, the workability of assembling the lid 5*a* and the housing 4 can be further improved.

In addition, the protruding piece 532 is fitted into the cutout portion 47 in a state where the engagement protrusion 44 is engaged with the periphery of the through hole 531. The protrusion 536 is fitted into the cutout recess 48. Further, the guide portion 45 is fitted into the engagement recess 537. The annular portion 53 is in contact with the stepped portion 49 in the axial direction. In addition, a plurality of sets of the through holes 531 and the engagement protrusions 44 to be engaged are arranged at substantially equal intervals in the circumferential direction. As a result, the housing 4 and the lid 5*a* are more firmly fixed in the axial direction and the circumferential direction.

Note that a gap may be partially formed between the outer peripheral surface of the annular portion 53 and the inner peripheral surface of the housing 4. As a result, vibration transmitted from the lids 5*a* and 5*b* to the housing 4 can be reduced.

While example embodiments of the present disclosure have been described above, it will be understood that the scope of the present disclosure is not limited to the above-described example embodiments, and that various modifications may be made to the above-described example embodiments without departing from the gist of the present disclosure. In addition, features of the above-described example embodiments and the modifications thereof may be combined appropriately as desired.

In the present example embodiment, a set of the through hole 531, the protruding piece 532, the groove 533, and the engagement recess 537, and a set of the engagement protrusion 44, the guide portion 45, and the cutout portion 47 are provided at four locations at equal intervals in the circumferential direction, but may be provided at two locations, three locations, or five or more locations.

Although the engagement protrusion 44 and the guide portion 45 are disposed adjacent to the attachment hole 461 in the radial direction, the engagement protrusion 44 and the guide portion 45 may be disposed at positions different from the attachment hole 461 in the circumferential direction. Further, the engagement protrusion 44 may be disposed at a position different from the guide portion 45 in the circumferential direction.

In addition, the housing 4 may be formed to have a diameter that decreases toward the axially lower side (one side in the axial direction). As a result, the airflow inside the housing 4 can be more smoothly circulated toward the exhaust side.

The present disclosure is applicable to, for example, a cooling device including a blower device.

Features of the above-described example embodiments and the modifications thereof may be combined appropriately as long as no conflict arises.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A blower device comprising:

a pair of fans that generates an airflow on one side in an axial direction along a central axis, the pair of fans being coaxially arranged with respect to one another;

a housing that has a tubular shape and extends along the central axis, the housing accommodating the pair of fans, two axial end surfaces of the housing being opened; and a lid that covers each of a first axial end surface and a second axial end surface of the housing, and provides ventilation; wherein the lid includes an annular portion that is in contact with an inner peripheral surface of the housing and includes a through hole penetrating in a radial direction; and the housing includes an engagement protrusion that protrudes radially inward from the inner peripheral surface and engages with a periphery of the through hole.

2. The blower device according to claim 1, wherein the through hole and the engagement protrusion to be engaged with each other define a set, and a plurality of the sets, including the set, are arranged at equal intervals in a circumferential direction.

3. The blower device according to claim 1, wherein the annular portion includes a protruding piece protruding in the axial direction from an axial end surface opposing an inside of the housing; and the through hole is adjacent to the protruding piece in the axial direction.

4. The blower device according to claim 3, wherein the protruding piece includes an inclined portion that is closer to one of the pair of fans in the axial direction than the through hole, and is inclined outward in the radial direction toward an outer side in the axial direction.

5. The blower device according to claim 1, wherein the housing includes:

a guide portion that is located axially outside from the engagement protrusion, protrudes radially inward from the inner peripheral surface, and extends axially;

the protruding piece includes:

a groove that is recessed radially inward from an outer peripheral surface and extends in the axial direction at an end portion in the axial direction opposing the inside of the housing; and the guide portion is movable along the groove, and the lid is insertable into the housing.

6. The blower device according to claim 5, wherein the protruding piece includes an engagement recess that is on a side farther from one of the pair of fans in the axial direction than the through hole, and is recessed radially inward from the outer peripheral surface; and the guide portion is fitted into the engagement recess.

7. The blower device according to claim 1, wherein the housing includes a flange portion protruding radially outward from an axially outer end portion;

the flange portion includes an attachment hole extending in the axial direction; and the engagement protrusion is radially adjacent to the attachment hole.

8. The blower device according to claim 1, wherein the housing includes:

a stepped portion which is in an axially outer end portion such that an inner peripheral surface of the stepped portion is recessed radially outward and is in contact with the annular portion in the axial direction; and a notch that is on an axially inner side of the engagement protrusion, and is defined by the stepped portion recessed axially inward; and the protruding piece is fitted into the cutout portion.

9. The blower device according to claim 1, wherein the annular portion includes:

a holding piece that protrudes radially outward from an outer peripheral surface and extends in a circumferential direction; and a holding recess that opposes the holding piece in the radial direction and is recessed radially inward from the outer peripheral surface; and a conducting wire connected to one of the pair of fans is held between the holding piece and the holding recess.

10. The blower device according to claim 1, wherein the lid includes:

a fixing portion which is located on a radially inner side of the annular portion and to which the fan is fixed; and a connecting portion that extends radially outward from the fixing portion, a plurality of the connecting portions being located in a circumferential direction and connecting the annular portion and the fixing portion; and the connecting portion of the lid located on another side in the axial direction is structured such that a cross-sectional area orthogonal to the central axis increases toward the one side in the axial direction.

11. The blower device according to claim 10, wherein the fixing portion of the lid located on the other side in the axial direction is structured such that a cross-sectional area orthogonal to the central axis increases toward the one side in the axial direction.

12. The blower device according to claim 10, wherein the fixing portion includes:

a fitting hole located on the central axis and penetrating in the axial direction; and an annular rib surrounding the fitting hole and protruding in the axial direction;

the fan includes a bearing holder in a cylindrical shape that holds a bearing inside, the bearing rotatably supporting a shaft extending along the central axis; and an axially outer end portion of the bearing holder is fitted into the fitting hole.

13. The blower device according to claim 1, wherein the housing has a diameter that decreases toward the one side in the axial direction.

* * * * *